US009080832B2

(12) United States Patent
Brahler, II et al.

(10) Patent No.: US 9,080,832 B2
(45) Date of Patent: Jul. 14, 2015

(54) QUICK-RELEASE VALVE AIR GUN

(71) Applicant: Gaither Tool Company, Inc., Jacksonville, IL (US)

(72) Inventors: Richard W. Brahler, II, Jacksonville, IL (US); Daniel J. Kunau, Boone, CO (US)

(73) Assignee: Gaither Tool Company, Inc., Jacksonville, IL (US)

( * ) Notice: Subject to any disclaimer, the term of this patent is extended or adjusted under 35 U.S.C. 154(b) by 0 days.

(21) Appl. No.: 14/020,824

(22) Filed: Sep. 7, 2013

(65) Prior Publication Data

US 2014/0331984 A1 Nov. 13, 2014

Related U.S. Application Data

(60) Provisional application No. 61/830,021, filed on May 31, 2013, provisional application No. 61/821,672, filed on May 9, 2013.

(51) Int. Cl.
*F41B 11/723* (2013.01)
*F41H 13/00* (2006.01)

(52) U.S. Cl.
CPC ..... *F41B 11/723* (2013.01); *F41H 13/0006* (2013.01)

(58) Field of Classification Search
CPC ..... F41B 11/60; F41B 11/62; F41B 11/72; F41B 11/723; F41B 11/73
USPC ..... 124/56, 59, 60, 70, 71, 73
See application file for complete search history.

(56) References Cited

U.S. PATENT DOCUMENTS

| | | | | |
|---|---|---|---|---|
| 1,459,775 | A | 6/1923 | Larnner | |
| 1,516,483 | A * | 11/1924 | Krafft | 124/69 |
| 2,441,186 | A | 5/1948 | Cooper | |
| 2,495,829 | A * | 1/1950 | Vincent | 124/69 |
| 2,515,068 | A | 7/1950 | Young | |
| 2,634,717 | A * | 4/1953 | Junkin | 124/75 |
| 2,841,359 | A | 7/1958 | Berk | |
| 2,919,714 | A | 1/1960 | Mrazek | |
| 2,972,998 | A | 2/1961 | Detwiler | |

(Continued)

FOREIGN PATENT DOCUMENTS

EP 0408921 A1 1/1991

OTHER PUBLICATIONS

Principle of the Axial Valve, unknown publication date, downloaded from http://www.duncanrogers.com/literature/axialvalve.pdf on about Jan. 25, 2011.

(Continued)

*Primary Examiner* — Bret Hayes
*Assistant Examiner* — Derrick Morgan
(74) *Attorney, Agent, or Firm* — Brevetto Law Group

(57) ABSTRACT

An air gun with a quick-release pneumatically operated gas valve that includes a piston positioned in a cylinder with one closed end so that the piston may seat against a gas outlet to close the gas valve. A control reservoir filled with gas to a control pressure is formed in the cylinder between the piston and the closed end of the cylinder so that the control pressure acts against the piston to close the gas valve. Opening a trigger valve allows the gas in the control reservoir to escape through an exhaust port, resulting in the gas valve being rapidly opened.

18 Claims, 12 Drawing Sheets

(56) References Cited

U.S. PATENT DOCUMENTS

| | | | | | |
|---|---|---|---|---|---|
| 3,101,733 | A | | 8/1963 | Lord | |
| 3,297,047 | A | | 1/1967 | Sime | |
| 3,380,469 | A | | 4/1968 | Salerno | |
| 3,399,689 | A | | 9/1968 | Keane | |
| 3,415,269 | A | | 12/1968 | Salerno | |
| 3,566,907 | A | | 3/1971 | Sime | |
| 3,580,274 | A | | 5/1971 | Hansen | |
| 3,680,540 | A | * | 8/1972 | Stengl | 124/73 |
| 3,742,968 | A | | 7/1973 | Kennedy | |
| 3,788,400 | A | | 1/1974 | Tufts | |
| 3,788,527 | A | | 1/1974 | Matson | |
| 3,866,654 | A | | 2/1975 | Duquesne | |
| 3,913,604 | A | | 10/1975 | Hanson | |
| 3,915,339 | A | | 10/1975 | Matson | |
| 3,971,412 | A | | 7/1976 | Wierzbicki | |
| 3,977,423 | A | | 8/1976 | Clayton | |
| 4,026,327 | A | | 5/1977 | Deinlein-Kalb | |
| 4,234,009 | A | | 11/1980 | Fuchs | |
| 4,285,495 | A | | 8/1981 | King | |
| 4,589,496 | A | | 5/1986 | Rozniecki | |
| 4,615,356 | A | | 10/1986 | Reip | |
| 4,676,402 | A | | 6/1987 | Stetson | |
| 4,732,189 | A | | 3/1988 | Jones | |
| 4,767,024 | A | | 8/1988 | Rappen | |
| 4,817,821 | A | | 4/1989 | Simoens | |
| 5,042,547 | A | | 8/1991 | Van De Sype | |
| 5,072,764 | A | | 12/1991 | Ochoa | |
| 5,143,256 | A | | 9/1992 | Wadensten | |
| 5,168,911 | A | | 12/1992 | Gottschalk | |
| 5,450,839 | A | * | 9/1995 | Nicolaevich et al. | 124/73 |
| 5,456,302 | A | | 10/1995 | Demers | |
| 5,487,527 | A | | 1/1996 | Eggleston | |
| 5,842,501 | A | | 12/1998 | Powell | |
| 5,853,160 | A | | 12/1998 | Hurdis | |
| 6,161,570 | A | | 12/2000 | McNeely | |
| 6,179,033 | B1 | | 1/2001 | Demers | |
| 6,318,406 | B1 | | 11/2001 | Conley | |
| 6,536,533 | B2 | | 3/2003 | Reilly | |
| 6,601,780 | B1 | * | 8/2003 | Sheng | 239/337 |
| 6,708,771 | B2 | | 3/2004 | Reilly | |
| 6,726,059 | B2 | | 4/2004 | Treat | |
| 6,925,997 | B2 | * | 8/2005 | Sheng | 124/74 |
| 6,981,842 | B2 | | 1/2006 | D'Angelo | |
| 7,395,749 | B2 | | 7/2008 | Adams | |
| 7,527,049 | B2 | * | 5/2009 | Sheng | 124/73 |
| 7,866,308 | B2 | * | 1/2011 | Jones et al. | 124/71 |
| 8,261,728 | B1 | * | 9/2012 | Tseng | 124/73 |
| 8,561,711 | B2 | | 10/2013 | Karalis | |
| 2002/0134365 | A1 | * | 9/2002 | Gray | 124/56 |
| 2003/0005918 | A1 | * | 1/2003 | Jones | 124/70 |
| 2003/0178151 | A1 | | 9/2003 | Ritchie et al. | |
| 2005/0183711 | A1 | * | 8/2005 | Eichner et al. | 124/73 |
| 2005/0188977 | A1 | * | 9/2005 | Wygant | 124/73 |
| 2006/0169265 | A1 | * | 8/2006 | Lai | 124/71 |
| 2007/0028909 | A1 | * | 2/2007 | Wood | 124/73 |
| 2008/0011283 | A1 | * | 1/2008 | Lai | 124/73 |
| 2009/0178660 | A1 | * | 7/2009 | Huang | 124/73 |
| 2010/0199961 | A1 | * | 8/2010 | Liao | 124/73 |
| 2011/0120437 | A1 | * | 5/2011 | Tippmann et al. | 124/74 |
| 2011/0253318 | A1 | * | 10/2011 | Kunau | 157/1.17 |
| 2012/0192707 | A1 | * | 8/2012 | Rogers et al. | 89/36.08 |
| 2012/0192847 | A1 | * | 8/2012 | Hague et al. | 124/77 |
| 2012/0318251 | A1 | * | 12/2012 | Tseng | 124/73 |
| 2013/0104868 | A1 | * | 5/2013 | Sikes | 124/77 |
| 2013/0239937 | A1 | * | 9/2013 | Macri et al. | 124/56 |

OTHER PUBLICATIONS

The DANFLO Family of Control Valves, Nov. 2009, downloaded from http://www.mandjvalve.com/literature/MJ-1690_DANFLOfamily_mj.pdf on about Jan. 25, 2011.

Pneumatically Operated Deluge Valve model 116FC, Mar. 16, 1999, downloaded from http://www.controlvalves.com/valveFiles/sWJNy-DGVpx-KNIGW-116FC_OM_with_sizes.PDF on about Jan. 25, 2011.

Unknown Author; "The Bead Seater" sales brochure; marketing info published by Astra Mfg. Inc., Manchester, N. H.; 2001.

* cited by examiner

QUICK-RELEASE VALVE AIR GUN

CROSS-REFERENCE TO RELATED APPLICATIONS

The present application claims priority from, and incorporates by reference in their entireties, U.S. provisional patent application 61/821,672 filed May 9, 2013 and U.S. provisional patent application 61/830,021 filed May 31, 2013.

BACKGROUND

1. Technical Field

Various embodiments of the present invention relate to air guns for firing projectiles. More specifically, the various embodiments relate to embodiments of a quick-release valve air gun.

2. Description of Related Art

Air guns use compressed air to accelerate a projectile down the barrel and out the muzzle. Some air guns hold enough compressed gas in the compression chamber to fire multiple shots. Other air guns must be recharged with compressed gas after each shot. Some air guns are recharged from another source of compressed gas such as a piston driven gas compressor or a storage tank. Other air guns recharge by forcing a firing piston of the gun down a compression tube to create sufficient pressure in the gun's compression chamber. All air guns have some sort of valve or other mechanism to inject air into the barrel behind the projectile.

BRIEF SUMMARY

The present inventors recognized that the ability of the air gun's valve to rapidly open and fill the barrel with pressurized air directly affects the shooting characteristics of the air gun. Various embodiments of the quick-release valve air gun disclosed herein feature a novel quick-release valve designed as an integral part of the air gun. Various embodiments disclosed herein feature a quick-release valve air gun with a barrel and a high speed gas valve with a primary gas reservoir. The gas reservoir is configured with a primary gas outlet in gaseous communication with the breech end of the barrel and an inner edge disposed within the primary gas reservoir body, or otherwise in gaseous communication with the primary gas reservoir. A piston with a chamfered outer end is configured to mate up with a portion of the primary gas outlet as the gas valve is closed. The piston slides back and forth within a piston receptacle mounted within the primary gas reservoir body. The inner end of the piston and inner walls of the piston receptacle form a control reservoir. The quick-release valve air gun has a trigger mechanism which, upon being triggered, releases control chamber gas from the control reservoir, reducing pressure in the control reservoir and causing the piston to slide away from the inner edge of the primary gas outlet, thus opening the gas valve and firing the projectile from the quick-release valve air gun.

BRIEF DESCRIPTION OF THE DRAWINGS

The accompanying drawings, which are incorporated in and constitute part of the specification, illustrate aspects of the various embodiments. Together with the general description, the drawings serve to explain the principles of the various embodiments. In the drawings.

DETAILED DESCRIPTION

The present inventors recognized that improved firing characteristics could be realized by more rapidly releasing pressurized gas into the chamber behind the projectile. The present inventors also recognized that firing performance gains could be realized by increasing the rate of the stream of gas entering the breech end of a barrel behind the projectile, pushing it down the barrel and out the muzzle. The novel design of the quick-release gas valve 117, which is in gaseous communication with the barrel, aids in enhancing the effective force driving the projectile down the barrel and the projectile muzzle velocity. As a result, the novel designs of the quick-release valve air gun disclosed herein can be used to increase the projectile muzzle velocity or shoot heavier projectiles for various applications. In addition, the performance gains realized through use of the novel design of air valve 117 and the barrel design allow some embodiments of the gun to optionally use a smaller, more easily portable gas storage tank. For a given projectile embodiments of the quick-release valve air gun disclosed herein are able to achieve the same muzzle velocity with less pressure in the high pressure supply tank as compared to conventional air guns. For example, conventional air guns often require 150 to 200 psi to launch a given projectile with a suitable muzzle velocity. The novel design of air valve 117 enables the same projectile to be launched at the same muzzle velocity with much lower pressures in the primary supply tank 107, for example, with pressures well under 100 psi. Some embodiments utilize primary supply tank 107 pressures of 60 psi or less, while other embodiments use primary supply tank 107 pressures of 50 psi or less, or 40 psi or less, to launch the given projectile with the same suitable muzzle velocity.

In this detailed description, various specific details are set forth by way of examples in order to provide a thorough understanding of the relevant teachings. However, it is apparent to those of ordinary skill in the art that various aspects of the present teachings may be practiced without all such details. In some instances, well known methods, procedures and components have been described at a relatively high-level, without excessive detail, in order to avoid unnecessarily obscuring novel aspects of the various embodiments. A number of descriptive terms and phrases are used in describing the various embodiments of this disclosure. These descriptive terms and phrases are used to convey a generally agreed upon meaning to those or ordinary skill in the art unless a different definition is given in this specification. Some of the descriptive terms and phrases used in this detailed description are presented in the following paragraphs for clarity.

Figure 1A:
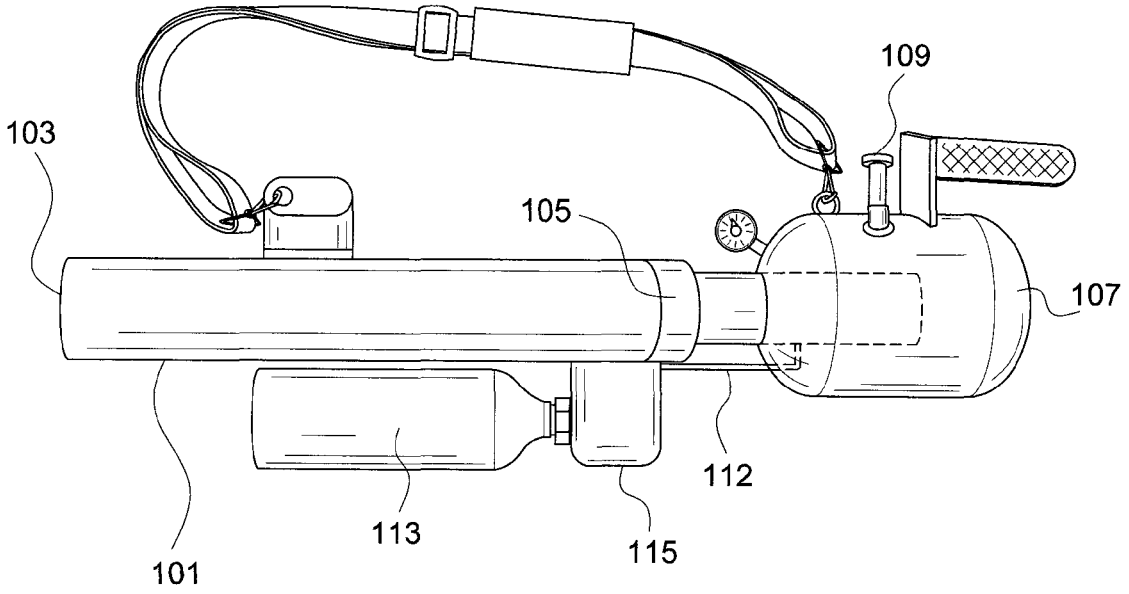
FIGS. 1A and 1B depict two implementations of the quick-release valve air gun according the various embodiments disclosed herein.
Figure 1B:
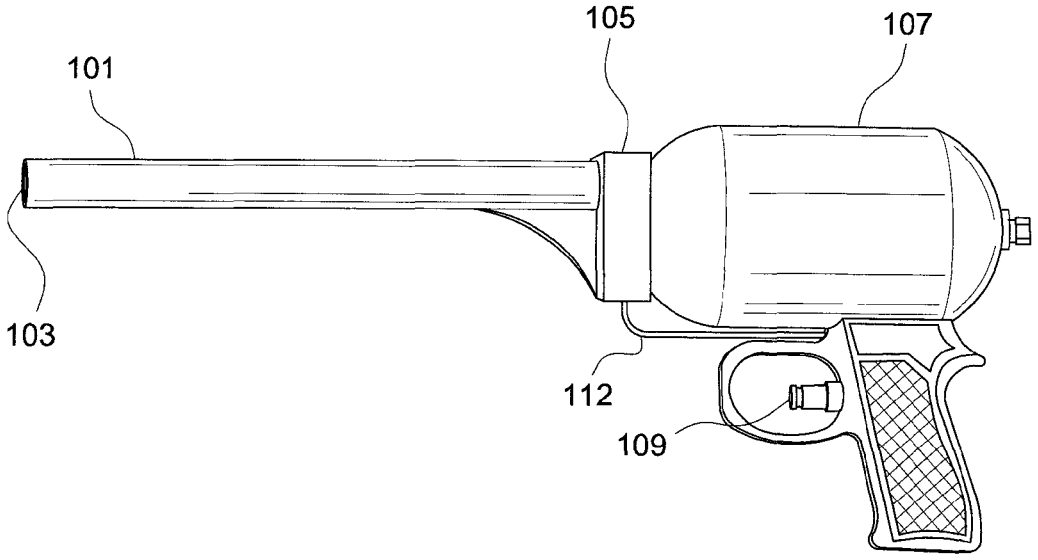

FIGS. 1A and 1B depict two implementations of the quick-release valve air gun according the various embodiments disclosed herein. Various embodiments of the quick-release valve air gun features a barrel 101 with a substantially round muzzle 103. Other embodiments feature barrel cross-sections of different shapes to accommodate various projectiles, including for example, a square barrel, a rectangular barrel, an octagonal barrel, a triangular barrel, an oval barrel (or curved non-round shaped barrel), or other like barrel interior cross-sections as would be understood by those of ordinary skill in the art. For example, an embodiment used to launch an unmanned aerial vehicle (UAV) uses a square barrel because the UAV is folded up when being launched and then unfolds upon launch. Some barrel cross-sections are non-symmetrical about both axes, or otherwise custom shaped for a particular application. For example, a grenade launcher embodiment has a substantially round cross-section with a groove running the length of the barrel. The groove accommodates the handle of the grenade when it is compressed before pulling the pin out. In this way the grenade handle remains compressed while in the barrel. In at least some grenade launcher embodiments, as well as embodiments designed to shoot various types of explosives, the quick-release valve air gun is configured with an arming mechanism on the barrel that arms the grenade or other explosive device as it is fire. In this way the grenade or other explosive device is not armed while sitting in the chamber waiting to be fired to avoid an accidental detonation. But as the grenade or other explosive device leaves the barrel (or as it travels through the barrel) the arming mechanism arms the grenade/explosive device. The arming mechanism may include a mechanical sensor, a magnetic sensor, a light sensor, a mechanical switch, an electrical switch, a pin that is removed, or other means to arm the grenade/explosive device as would be known by one of ordinary skill in the art.

The projectile is propelled through the barrel 101 and out the muzzle 103 by release of the pressurized gas through the novel quick release gas valve 105 at the breech end of barrel 101, opposite the muzzle end 103. The pressurized gas; typically air under pressure, is stored in a supply tank 107, sometimes called a primary gas supply tank. The primary gas supply tank can be implemented in various sizes. A typical sized primary gas supply tank is up to six inches in inside diameter (measured laterally, that is, perpendicular to the centerline of the barrel). Other embodiments are up to two inches diameter, or up to four inches in diameter. Firing the quick-release valve air gun caused the gas pressure to reduce in the primary supply tank 107. To fire the air gun again it needs to be charged up with pressurized gas. Some embodiments simply have a coupling such as a quick disconnect coupling used to connect an air compressor, a bicycle pump (or other hand pump), or other supply of pressurized gas. Other embodiments feature a second tank, often called a resupply tank 113, to recharge the primary supply tank 107. Typically, gas in the resupply tank 113 is kept under higher pressure than the gas of the primary supply tank 107. A regulator 115 or auto-refill valve may be provided between the primary supply tank 107 and the supply tank 107 to regulate the pressure entering into the supply tank 107. The efficiency and speed of the quick-release gas valve 117 enables the use of a smaller primary supply tank 107, including primary supply tank 107 volumes of from 25 cubic inches to 500 cubic inches and any volume or range of volumes between 25 to 500 cubic inches.

A trigger mechanism 109 may be used to manipulate the high speed gas valve 105, thus releasing the pressurized gas through the valve into the barrel 101 behind the projectile. This is done by controlling the trigger mechanism 109 to switch a release valve (sometimes called a trigger valve) from the closed state to an open state, allowing air (or other gas) to escape from a control reservoir which holds a piston closed within the quick-release valve, thus opening the quick-release valve to shoot a projectile from the muzzle end of the quick-release valve air gun barrel. In some embodiments the trigger mechanism 109 may be configured as part of the release valve itself, for example, as a plunger, lever, push-rod, switch, or other like type of activating mechanism, as per FIG. 1A. In other embodiments the trigger mechanism 109 may be separate from the release valve, for example, an electrical or mechanical switch apart from the release valve, but configured in a manner to controllably activate the release valve, e.g., via electrical wires, a pneumatic tube, or mechanical linkage, as per FIG. 1B. In FIG. 1B the trigger mechanism 109 is connected to the high speed gas valve 105 by a pneumatic tube 111 which is in gaseous communication with the control reservoir. Manipulating (or activating) the trigger mechanism 109 reduces the control pressure, causing the piston to slide backwards (e.g., in a direction away from the muzzle end of the air gun) and open the quick-release valve to an open state. This releases pressurized gas behind the projectile, firing the projectile down the barrel and out the muzzle.

The quick-release valve air gun may be configured in a number of implementations with various specialized features for performing different functions. For example, some embodiments of the quick-release valve air gun are directed to firing lethal (or potentially lethal) projectiles for hunting or for self-defense. Some embodiments are configured to fire non-lethal projectiles such as netting or rope, tear gas canisters, a bolo, flexible non-lethal projectiles, or other non-lethal projectiles for crowd control or self-defense purposes. The crowd control projectile embodiments include dyes for marking certain people (e.g., marking people for later arrest), drugs or mildly toxic substances to anesthetize or otherwise incapacitate a person or persons, or to disperse a crowd. Other embodiments are configured to fire chaff to produce electromagnetic interference and false targets as a countermeasure for electronic detection (e.g., radar). Some embodiments are configured to fire or launch relatively heavy projectiles to breach doors, windows, walls or other structural components so as to afford access by law enforcement officials or military personnel. Some embodiments are configured to launch items to be conveyed such as tee-shirts, hot dogs, prizes, literature or flyers, or other marketing-related items. Other embodiments are configured to launch projectiles such as fireworks, or explosives either for military purposes or peacetime uses such as explosive devices intended to create snow avalanches so as to eliminate potentially dangerous conditions, e.g., near ski slopes or mountainous territory near roads, structures or people. Some embodiments are configured to spread fertilizer, animal feed, seed grains, pesticides, or other agricultural products. Yet other embodiments are configured to launch a robot, a drone, or other type of remote control vehicle that may be equipped with one or more of cameras, weapons, firefighting materials, or construction materials.

Figure 1C:
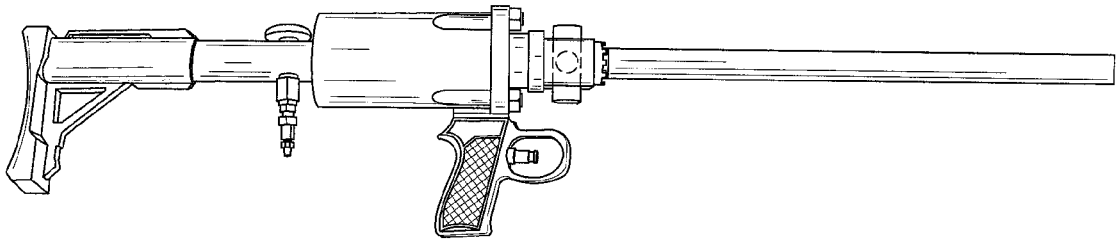
FIGS. 1C and 1D depict a side view and an oblique view of a long barreled, high pressure embodiment of the quick-release valve air gun.
Figure 1D:
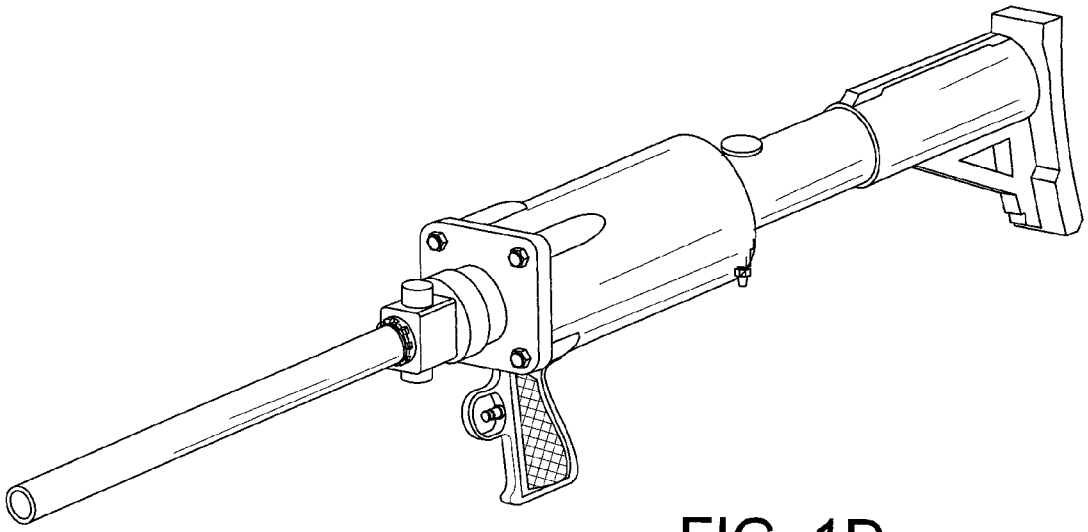

Different embodiments of the quick-release valve air gun feature varying barrel diameters and lengths, depending upon the desired firing characteristics. The barrel can be as short as one inch (just long enough to hold a projectile) or as long as eight feet. Barrel diameters range from approximately ⅛ inch to as much as 16 inches, depending upon the application. The embodiment depicted in FIG. 1C has a barrel length of approximately 22 inches. Generally, the longer barrel length aids in more accurately shooting a projectile longer distances. Some embodiments accurately shoot a projectile two hundred yards or more, while other long barreled embodiments are capable of shooting at targets as far as 400 yards or more away. Other embodiments have been fabricated with barrel lengths of only one inch. Such short barrel lengths are more readily portable since the gun is smaller, but tend to be much less accurate. By contrast, other embodiments of the quick-release valve air gun have barrel lengths of eight feet or more.

Figure 2A:
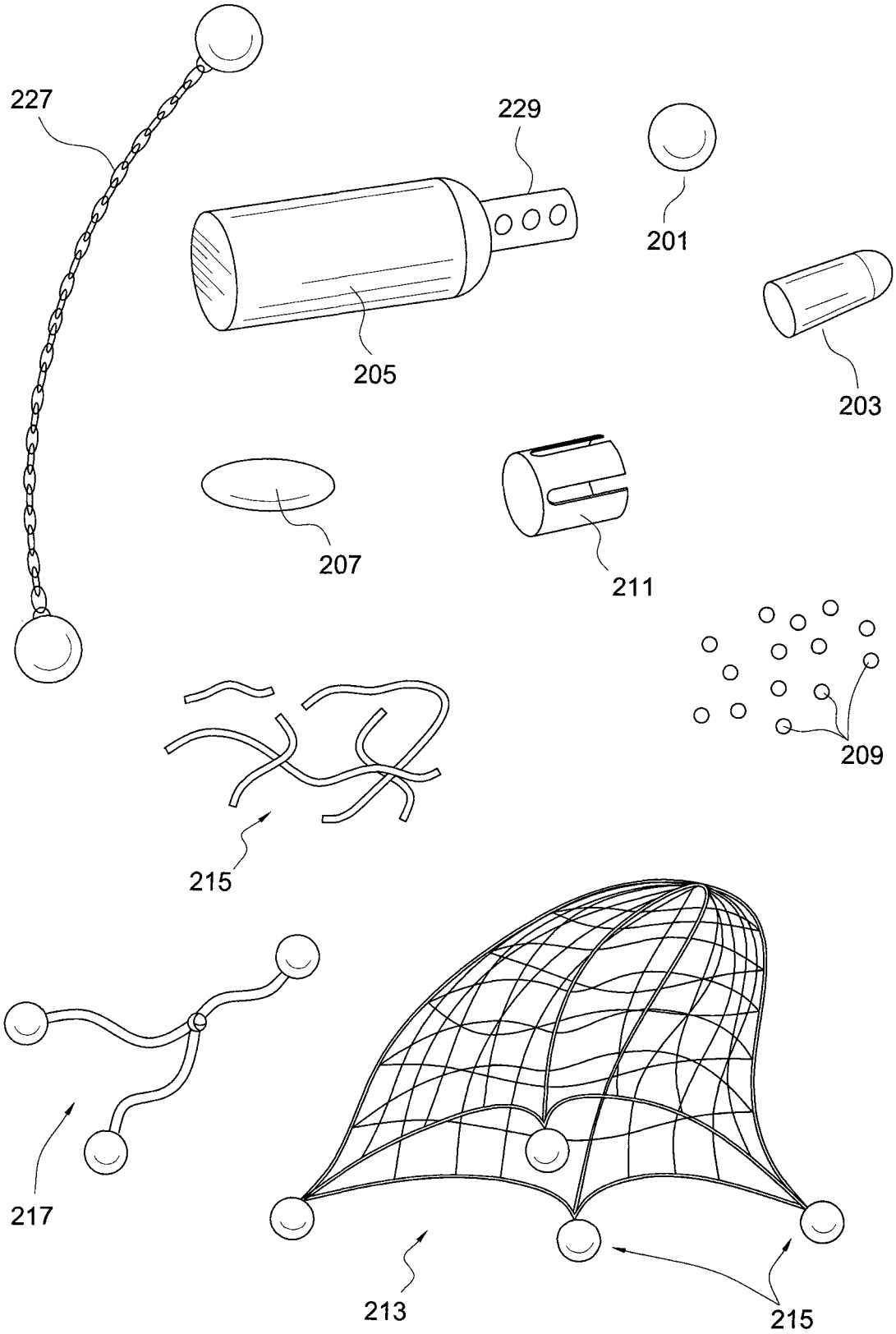
FIG. 2A depicts examples of projectiles suitable for use in various embodiments of the quick-release valve air gun.
Figure 2B:
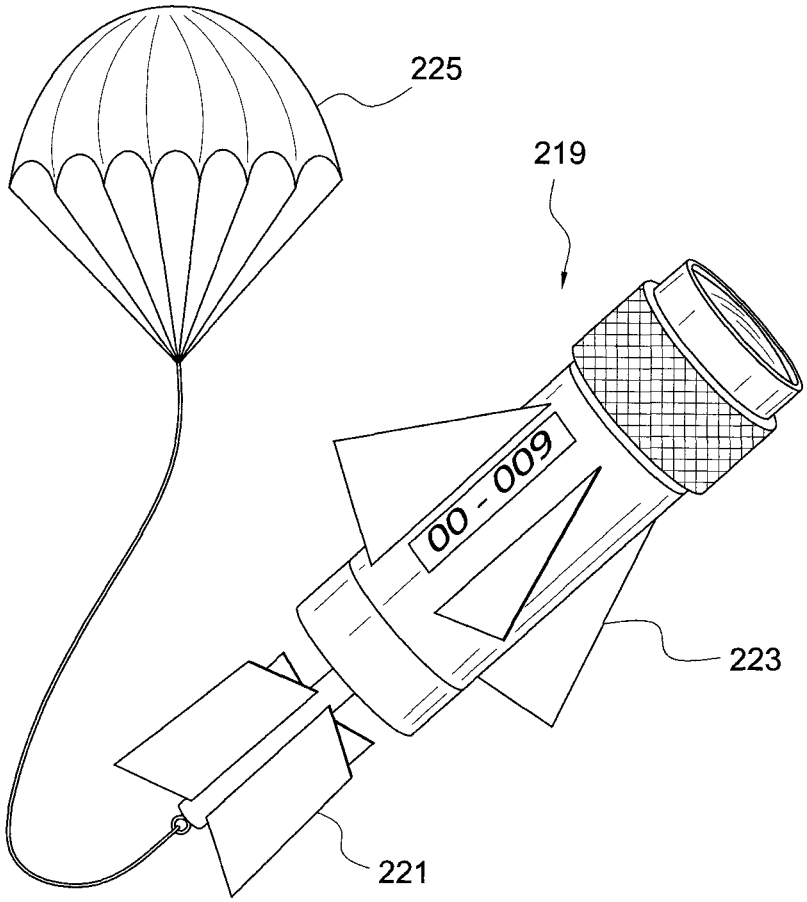
FIG. 2B depicts a camera configured to be launched from the quick-release valve air gun.

FIGS. 2A-2B depict some examples of projectiles suitable for use in various embodiments of the quick-release valve air gun. The projectiles are embodied in various shapes, weights and sizes, depending upon the intended use and function. For example, a relatively dense material such as a lead or steel ball 201 is suitable as a lethal projectile for use against human or animal targets. The relatively dense material may be shaped as a cylinder or bullet shape 203. Typical weighs for projectiles used for human or animal targets include weights in the range from 0.3 ounces to 1 pound. Larger projectiles of heavy materials are used to inflict structural damage, e.g., punching holes in walls or breaching doors or windows, or breaking door lock mechanisms or hinges. Typical weighs for such use include any weight within the range of from 1 pound to 25 pounds. Relatively large sized, lighter weight projectiles may be used as non-lethal weapons. It should be noted that the gas valve of conventional air guns—for example, paint guns—cannot simply be scaled up in size to shoot a larger, heavier projectile. An attempt to scale such conventional valves up in size to launch heavier projectiles tends to be deficient in two respects. First, an attempt to scale up the gas valve of a conventional air gun tends to be leaky due to the higher pressures required to launch a heavy projectile. Secondly, such scaled up valves do not open rapid enough to eject a heavy projectile (e.g., greater than three pounds) with enough force to attain a suitable firing trajectory, or breach a door or wall. By contrast, the quick release gas valve of various embodiments of the quick-release valve air gun can be implemented for applications with smaller projectiles (e.g., paintball guns) or larger projectiles (e.g., tactical door breaching projectiles, small robots, cameras, or other relatively heavy projectiles).

Various embodiments of the quick-release valve air gun are tailored to launch myriad different types of projectiles of vastly different sizes, shapes and weights. Some of the typical projectile shapes include spherical 201, pill shaped or cylinder shaped 203, oblong shaped 207, and shot shaped 209 (multiple smaller projectiles). In some implementations the shot 209 consists of shot all having the same diameter, size or shape. In other implementations the shot 209 consists of shot all having varying diameters, sizes or shapes. Shot 209 includes spherical shaped shot in some implementations, while in other implementations the shot 209 includes jagged or otherwise asymmetrical shapes or a mixture of spherical and asymmetrical shapes. Some embodiments are configured to shoot nails, spikes, rivets or other construction fasteners. Other projectiles include various types of balls such as a golf ball, a football, a tennis ball, a baseball, a Kong Ball®, a camera 219, an aerosol canister 205, a paintball, and a Superball®. The canister 205 may be equipped with a nozzle 229 configured to spray the contents of the canister 205 either upon impact, at a predefined time after launch, or at a predefined point. In some embodiments, the nozzle 229 may be controllable via a communication link so the canister can be launched and then activated at a later time (after reaching the target) either under control of the user or by using a timing mechanism. Some embodiments of the quick-release valve air gun are configured to shoot nets 213, ropes 215, bolas 217, and chains 227, or other such projectiles for disabling a person, animal, vehicle, boat or other tactical target. In some implementations the projectiles are surrounded by a detachable sabot 211 as it travels down the barrel. Typically, the sabot 211 falls away from the projectile shortly after it exits the muzzle of the quick-release valve air gun.

Some embodiments of the quick-release valve air gun are configured to launch a camera 219, typically for surveillance purposes. FIG. 2B depicts a camera suitable for launching. The camera 219 may be either a still camera that takes photographs and/or a video camera that captures video of the scene below for surveillance purposes. The images, either still or video (or both), may be communicated to the user via a communications link between camera 219 and a control unit. Alternatively, the images may be communicated to a command center other than the user who launches the camera, e.g., via a satellite link or by direct communications link. Various embodiments of the camera 219 include a parachute 225 configured to either deploy at the maximum height of the trajectory, another predefined height or location above a target, or under control of the user or command center. In various embodiments the camera 219 is launched, a parachute 225 opens at the apex of its trajectory or other desired position, and the camera 219 takes photographs or video as it floats back to the ground. Typically, the camera 219 includes a telemetry link that adjusts the parachute 225, tail assembly 221 and/or the guidance fins 223. Embodiments of the camera 219 typically have a guidance system including a tail assembly 221 and/or one or more fins 223 designed to unfold while the camera 219 is in flight. The tail assembly 221 and/or fins 223 may be unfolded upon firing to aid in guiding the camera 219 to a vantage point suitable for observation. Alternatively, the camera 219 may be fired towards the desired vantage point with the tail assembly 221 and/or fins 223 remaining undeployed—that is, in a folded up state. Once the camera 219 reaches the desired vantage point and the parachute 225 (if any) is deployed, the tail assembly 221 and/or fins 223 may also be deployed to steer the camera 219 as it floats back towards the ground. The telemetry link can be used to focus the lens—or lenses, if more than one—and point the camera (s) towards a target being observed.

FIGS. 3A-G depicts an embodiment of the quick-release valve air gun 300 configured to shoot netting, ropes or bolas. To shoot netting, ropes or bolas from this embodiment of the air gun a user activates the trigger mechanism 309. This acts to open a release valve of the air gun, reducing the control pressure which keeps the quick-release valve closed. The reduction in control pressure causes the piston within the quick-release valve to open, releasing pressurized gas behind the projectile. The pressurized gas rapidly fires the netting, ropes or bolas from this embodiment of the quick-release valve air gun.

Figure 3A:
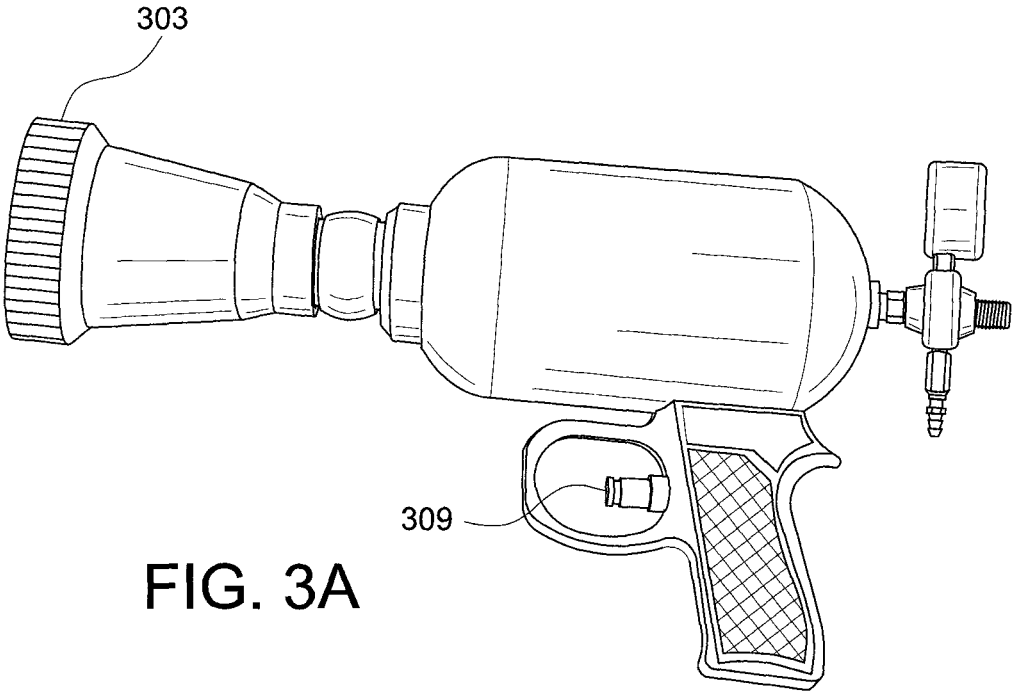
FIGS. 3A-G depict an embodiment of the quick-release valve air gun configured to shoot netting, ropes or bolas.
Figure 3B:
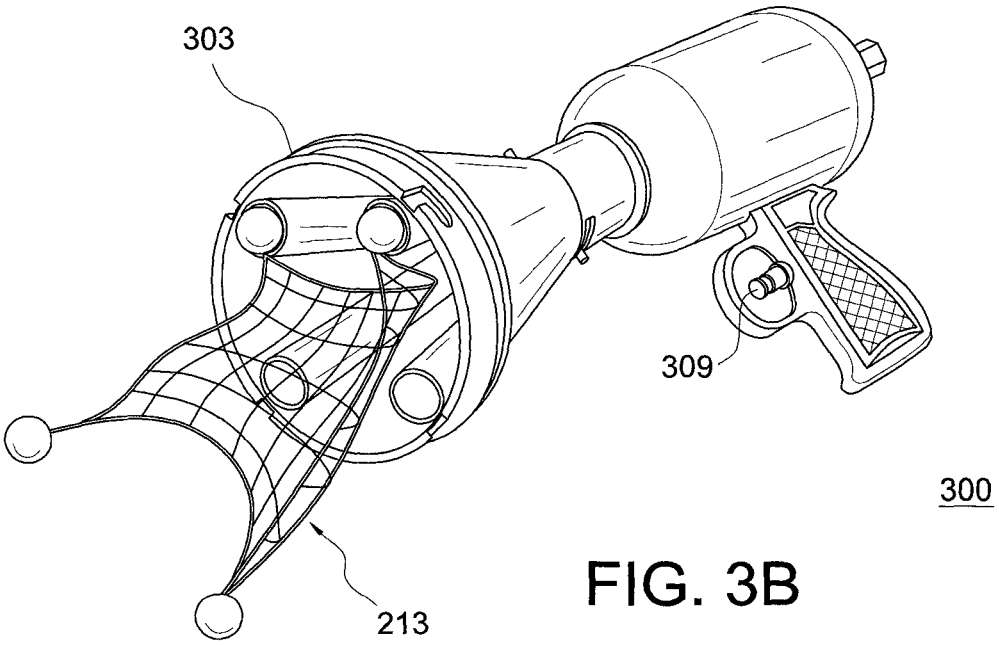

For example, various embodiments 300 of the quick-release valve air gun can shoot netting 213, rope 215 or bolas 217, and/or chains 227 as shown in FIG. 2A. Some embodiments of the quick-release valve air gun are configured with a barrel that is irremovably affixed to the stock, valve and trigger assembly and not intended to be removed with each shot. The embodiments depicted in FIGS. 3A and 3B are configured with a quick-release mechanism 301 that allows the netting head 303 (or head 305) to be quickly removed and replaced with a new head assembly. Through experimentation the present inventors found that it is more efficient to keep several netting heads 303 (or 305)for each air gun with a quick-release valve. Each of the heads can be loaded in advance with a net 213 prior to shooting the air gun with a quick-release valve. Once a net 213 is shot, the netting head 303 can be quickly removed from the quick-release valve air gun 300 and replaced with another netting head 303 that has been loaded with a net 213. The inventors have found that this arrangement allows the quick-release valve air gun 300 to be reloaded for shooting a new net within five seconds or less. Conventional air guns take two or three minutes to reload with a new net. The rope 215 and bolas 217 and chains 227 shown in FIG. 2A can be loaded in advance into a number of netting heads 303 in a manner similar to the netting 213. The head 303 is called a "netting" head herein for the sake of simplicity, even though netting head 303 can readily be used to shoot ropes 215 and bolas 217 and chains 227.

The novel netting head 303 features two or more tubes 321 that are splayed apart, aimed at an angle (or angles) outward from the centerline of the quick-release valve air gun 300. The tubes 321, for the purposes of this application, are considered barrels of this embodiment of the quick-release valve air gun. As such, the primary gas supply tank is in gaseous communication with the multiple tubes 321 via the quick release gas valve of the air gun. The tubes 321 are configured to receive net weights—that is, weights 215 attached to various points on the periphery of the net 213. The embodiment depicted in FIGS. 3D-G has four tubes 321. Other embodiments have different numbers of tubes. The four net weights 215 are positioned on (or placed within) the tubes 321. In some embodiments each of the net weights 215 has a small hole that fits over one of the tubes 321. In other embodiments the tube weights 215 are shaped (or have a portion shaped) like a bottle stopper or a cylinder that inserts into each of the tubes 321. In various embodiments, the act of firing the quick-release valve air gun blows the net weights 215 off of the tubes 321 (or out of the tubes), thus carrying the net 213 with the net weights 215 as they shoot towards the target. In some embodiments the net weights 215 are implemented as rubber balls with a predefined portion designed to fit within (or over) the tubes 321. In other embodiments the net weights 215 are covered with soft foam material to avoid injuring the target. In some embodiments the net weights 215 each weigh the same amount, while in other embodiments the net weights 215 may vary. For example, the net weights 215 place on (or in) the tubes 321 towards the top of the quick-release valve air gun may be heavier than the bottom-most net weights 215. The top-most net weights 215 in some implementations outweigh the bottom-most net weights 215 by at least 20% up to as much as 400% (that is, 5×) or by any percent within this range. Although the embodiments depicted in FIGS. 3D-3G have four tubes, various other embodiments have as few as two tubes or as many as 20 tubes. The tubes 321 have a path to the valve of the quick-release valve air gun 300 so that, upon firing the gun, a stream of pressurized gas is directed down each of the tubes 321.

As shown in depicted in FIGS. 3D-3G the tubes 321 are splayed apart at a predefined angle (or angles). Splaying the tubes apart aids in opening the net as it shoots from the quick-release valve air gun 300 (or separating the bolas 217). The splaying angle 317 is the angle measured away from the centerline 319 bisecting the quick release assembly connecting the netting head 303 to the quick-release valve air gun 300's air tank. In one embodiment the splay angle is substantially 15 degrees. Substantially 15 degrees is defined as 15 degrees plus or minus 10 percent. In various embodiments the splay angle may be as large as 45 degrees or as small as 5 degrees. In some embodiments the top-most tubes (tubes oriented towards the top of the gun) are aimed higher than the bottom-most tubes. For example, the two top-most tubes may be splayed outward (horizontally) by 15 degrees and upward (vertically) by 20 degrees, while the two bottom-most tubes are splayed outward by 15 degrees and downward by 15 degrees.

The present inventors discovered that having the tubes all splayed at the same splaying angle sometimes results in the net opening as it is shot from the quick-release valve air gun 300, and then closing back towards each other as the net 213 shoots towards its target. This happens because the net weights 215 stretch the net out to a fully opened position, and are then pulled back together by the elasticity of the net 215. The present inventors discovered that this problem can be avoided by splaying the different tubes 321 at different splay angles 317. For example, one tube 321 may be splayed at 15 degrees while the tube opposite it is splayed by 13.5 degrees. In some embodiments the each of the splay angles 321 differs from the others while falling within a range of 15 degrees (or some other predetermined angle) plus or minus 10 percent. In other embodiments, two of the splay angles may be equal so long as the tubes having equal splay angles are not located opposite each other. In yet other embodiments the tubes 321 opposite each other are not located on the same plane—that is, they are skewed. In other words, extending a central line through each of the skewed tubes 321 would not result in the lines intersecting each other. In yet other embodiments there is an odd number of tubes 321 to ensure that the net weight 215 are not located at points on the net 213 opposite from each other. In regards to the embodiments of the netting head 303 configured for a bolas 217, the head 303 typically has as the same number of tubes as there are bolas weights. In some contexts of language, the term "bolas" implies three weights attached by rope. However, in the present context and in accordance with the various embodiments disclosed herein the bolas 217 can have as few as two weights or as many as ten weights.

Figure 3C:
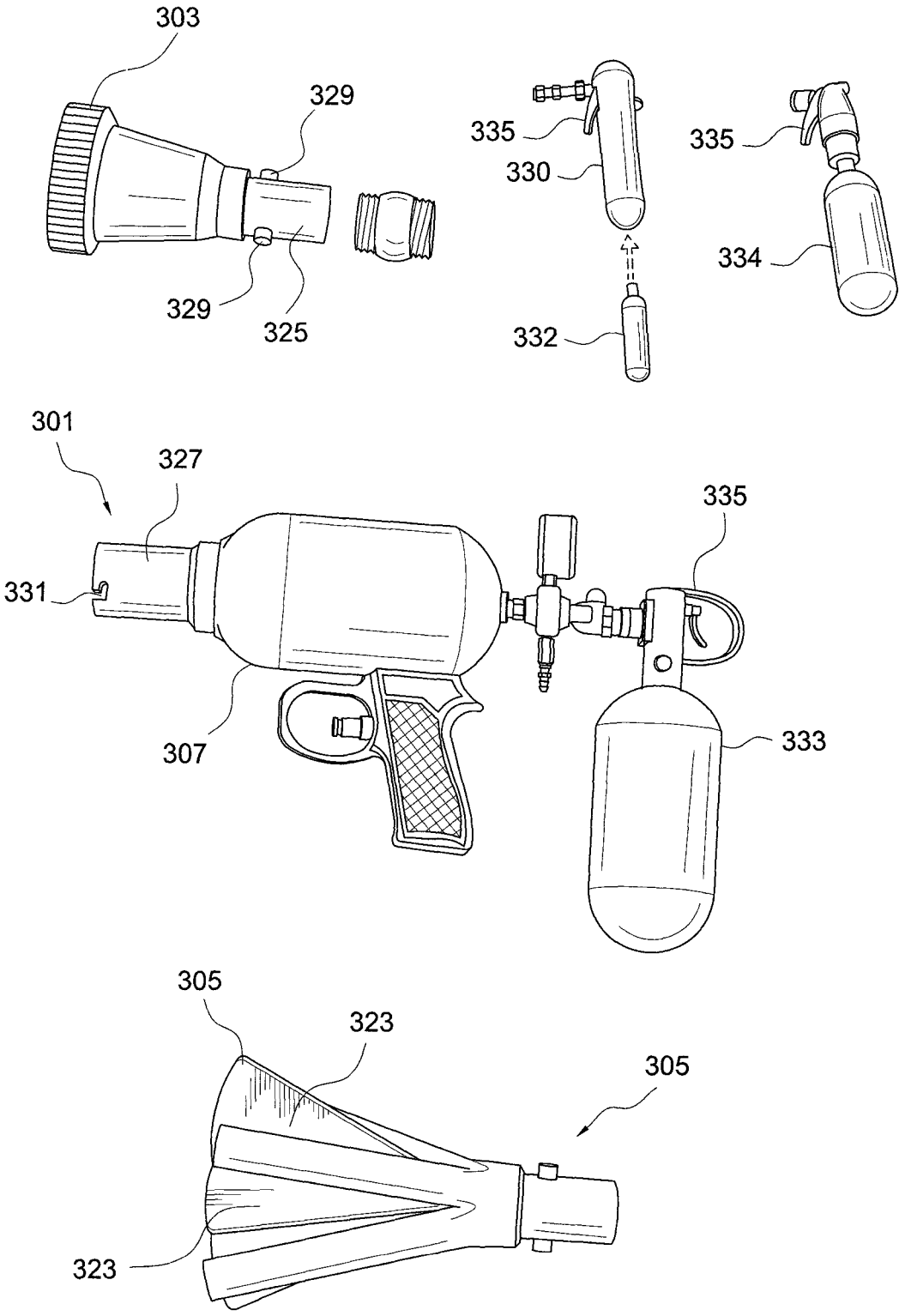
Figure 3D:
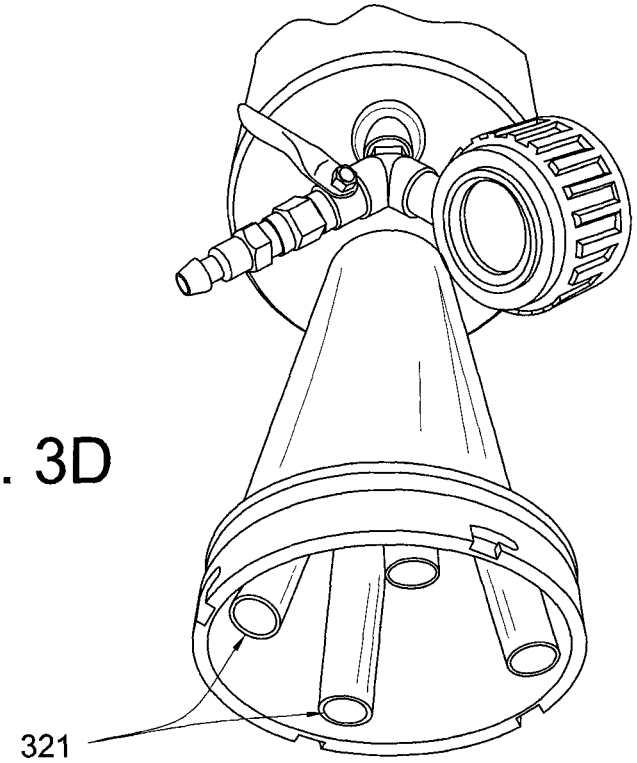
Figure 3E:
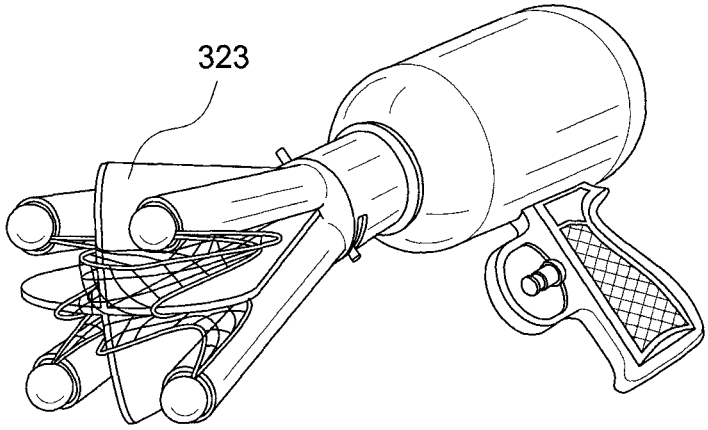
Figure 3F:
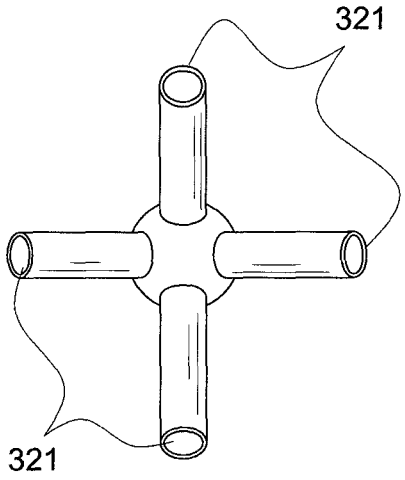
Figure 3G:
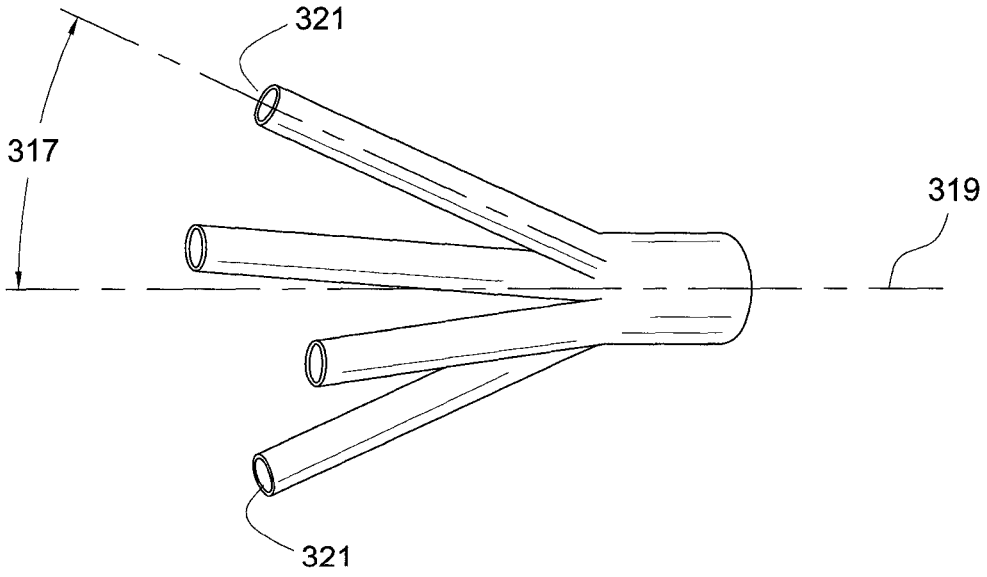

The netting head 303 of FIG. 3C is configured with tubes inside a conical shaped enclosure. To load netting head 303 the netting 213 is pushed into the cone between the tubes 321. By contrast, netting head 305 of FIG. 3C does not have a conical shaped enclosure. Instead, netting head 305 has one or more net holding members 323 positioned between the tubes 321. The net holding members 323, in at least one embodiment, are pieces of angle iron affixed among the tubes 321. In another embodiment the net holding members 323 are lengths of strap iron positioned among the tubes 321. Typically, the net holding members 323 do not have sharpened edges. Instead, to avoid tearing the net 213 the net holding members 323 have rounded smooth edges to allow the netting 213 to easily slide off when the quick-release valve air gun is fired. The net holding members 323 of netting head 305 serve the purpose of holding the netting 213 within the head until the quick-release valve air gun is fired. In some embodiments the net holding members 323 are configured with a hollowed out cavity between the tubes 321 to accommodate nets 213 or ropes 215 or chains 227.

The embodiment depicted in FIG. 3C features a second tank 333, often called a resupply tank, to recharge the primary gas supply tank 307 of the quick-release valve air gun 300. The pressurized gas stored in primary gas supply tank 307 is used in firing the quick-release valve air gun 300. To recharge primary gas supply tank 307 the user activates supply valve 335, releasing pressurized gas from supply tank (or supply source) 333. Typically, the supply valve 335 is closed before again firing the quick-release valve air gun 300 in order to isolate supply tank 333 from primary gas supply tank 307. In some embodiments the resupply tank may actually be smaller sized than the primary tank, albeit filled at a somewhat higher pressure so as to hold more gas. Some embodiments use pressurized $CO_2$ canisters as the resupply tank. For example, resupply tank 330 of FIG. 3C is a small $CO_2$ canister that fits into a canister holding mechanism 332. The bottom portion of canister holding mechanism 332 unscrews to accept the resupply tank 330 in a manner akin a battery fitting into a flashlight. When the bottom portion is screwed back onto canister holding mechanism 332 a pin punctures resupply tank 330, releasing its pressurized $CO_2$ into canister holding mechanism 332. The canister holding mechanism 332 is configured with a supply valve 335 that can be operated to refill the primary supply tank 307. In another embodiment, the resupply tank 334 is a larger, refillable canister with threads on its neck to screw into a supply valve assembly 335.

The embodiments of the quick-release valve air gun depicted in FIGS. 3A-E are configured with a quick-release mechanism that allows a user to quickly and conveniently change the gun's barrels or netting heads. The quick release mechanism 301 includes two parts—the barrel portion 325 of the netting head and the barrel receptacle 327 of the air gun. As shown in FIG. 3C the netting head 303 is configured with a barrel portion 325 of the netting head 303 that slides into the barrel receptacle 327 of the quick-release valve air gun. (The netting head 305 is configured in a similar manner.) The barrel portion 325 of the netting head is configured with two small cylinder shaped protuberances 329. The protuberances 329 fit into L-shaped slots 331 on the barrel receptacle 327 as the barrel portion 325 that slides into the barrel receptacle 327 of the air gun. In some embodiments the protuberances 329 and L-shaped slots 331 are not located directly across from each other (180 degrees apart). For example, in some embodiments the protuberances 329 are located 170 degrees around the barrel portion 325 (rather than 180 degrees), with the L-shaped slots 331 positioned in a similar manner on the barrel receptacle 327 of the air gun. This ensures that the netting heads 303 and 305 will be mounted in the correct orientation, right side up. As described in the disclosure below, some embodiments feature the top-most tubes 321 of the netting heads aimed at a slightly higher angle than the bottom-most tubes 321, and/or, in some embodiments the top-most net weights 215 may be heavier than the bottom-most net weights 215.

In some embodiments the projectile is loaded into the muzzle end of the barrel. In other embodiments the projectile is loaded into the opposite, breech end of the barrel. In some embodiments the projectiles are loaded one at a time, by hand. In other embodiments the projectiles are loaded using a loading mechanism.

Figure 4A:
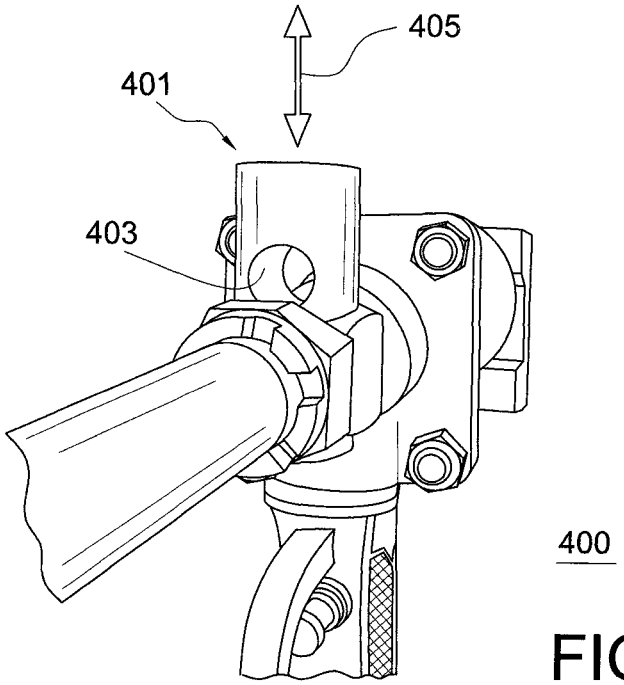
FIGS. 4A-B depict loading mechanisms according to two embodiment of the quick-release valve air gun.
Figure 4B:
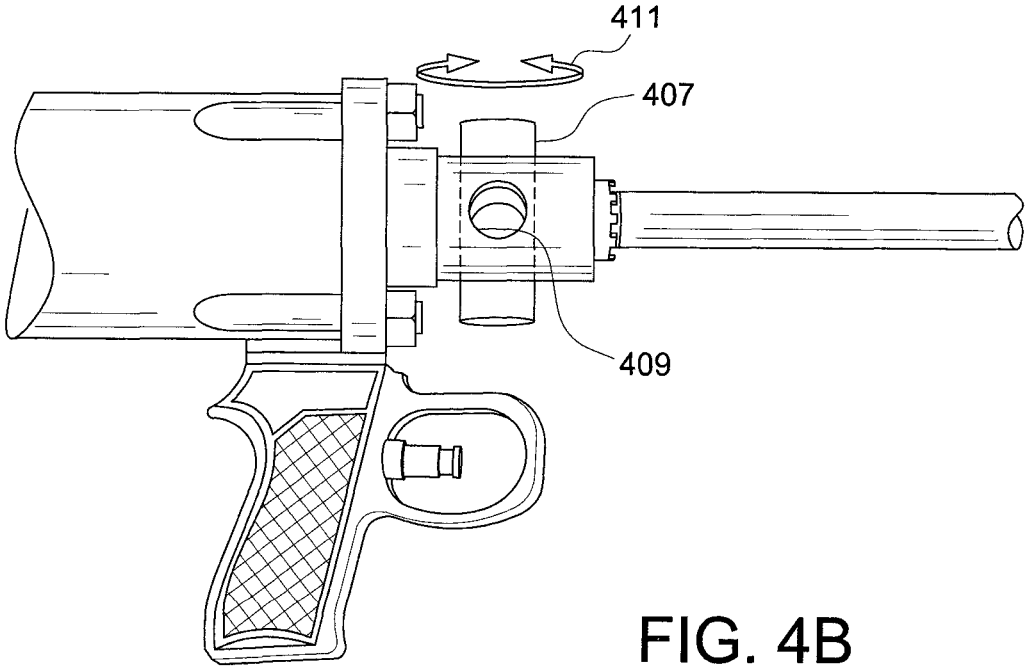

FIGS. 4A-B depict loading mechanisms according to two embodiment of the quick-release valve air gun. In some embodiments the projectile is loaded into the muzzle end of the barrel. In other embodiments the projectile is loaded into the opposite, breech end of the barrel, for example, as depicted in the embodiments of FIGS. 4A-B. In some embodiments the projectiles are loaded one at a time, by hand, after each firing of the quick-release valve air gun. In other embodiments the projectiles are loaded using a loading mechanism activated by firing the previous shot. Some loading mechanism embodiments are powered by the escaping compressed gas from firing of the projectile. Other embodiments loading mechanism embodiments are operated by the user, for example, similar to a bolt action rifle. The embodiment 400 shown in FIG. 4A has a projectile holding part 401 configured to slide up and down in a direction 405. To load the embodiment of FIG. 4A the projectile holding part 401 is slid upwards to expose a projectile holding chamber 403, allowing the user to load a projectile into the chamber 403. The projectile holding part 401 is then slid back down to align the front of chamber 403 with the barrel and expose the back of chamber 403 to the gas valve of the quick-release valve air gun. In other embodiments the projectile holding part 401 is configured to slide side to side in a direction perpendicular to the direction 405 and the barrel. In the embodiment of FIG. 4B the projectile holding part 401 is produced in a cylindrical shape (with axis in the up/down direction) and configured to twist so the chamber 403 lines up with a hole 409 in the breech unit to accept a projectile, and then twist back so the chamber 403 lines up with the barrel. To minimize the gas leakage when the quick-release valve air gun is fired the projectile holding part 401 is configured to fit relatively tightly within the slotted hole as it slides up and down in FIG. 4A or twists in FIG. B, yet with enough clearance to avoid binding up as projectiles are shifted into firing position within the air gun.

In other embodiments the magazine is not sealed off from the pressure of the barrel, instead being configured to maintain an airtight seal with the barrel. This avoids high pressure gas leaks through the magazine. The airtight magazine, in some embodiments, is connected to the barrel assembly using a quick-release mechanism.

Figure 5A:
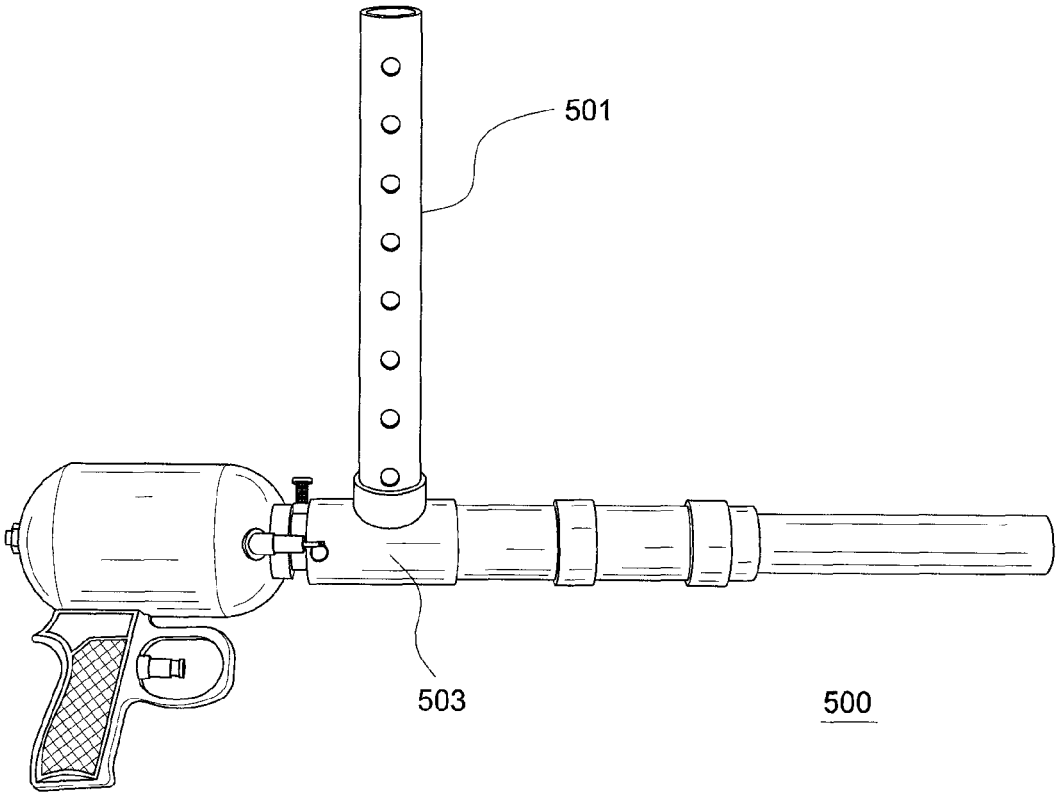
FIG. 5A depicts an embodiment of a gravity feed hopper load mechanism.

FIG. 5 depicts an embodiment 500 of a gravity feed hopper load mechanism. Some embodiments of the quick-release valve air gun have a projectile hopper or magazine that is sealed off from the barrel once the projectile is loaded. In this way the hopper or magazine need not be airtight. The embodiment 500 has a feeding mechanism—the gravity feed hopper 501—that is not airtight. The embodiment 500 is designed to load golf balls or other projectiles into the air gun's firing chamber 503. Golf balls are loaded into the top of gravity feed hopper 501. The force of gravity feeds the golf balls downward, with the bottommost golf ball being positioned in the firing chamber 503, and then a latching mechanism seals off the hopper from the firing chamber of the quick-release valve air gun. In the particular implantation shown the latching mechanism slides the barrel relative to the gravity feed hopper 501, moving the barrel towards the user. Upon firing the quick-release valve air gun, the latching mechanism is exercised by the user to drop the next golf ball into place, ready for firing. The holes cut into the side of the gravity feed hopper 501 allows a user to see how many golf balls remain to be fired before reloading is needed. One drawback of embodiment 500 is that, unless the latching mechanism is tightly sealed to contain the pressurized gas, the firing may tend to cause small streams of gas to leak out through the gravity feed hopper 501. This issue is solved by the embodiment depicted in FIG. 6A.

Figure 5B:
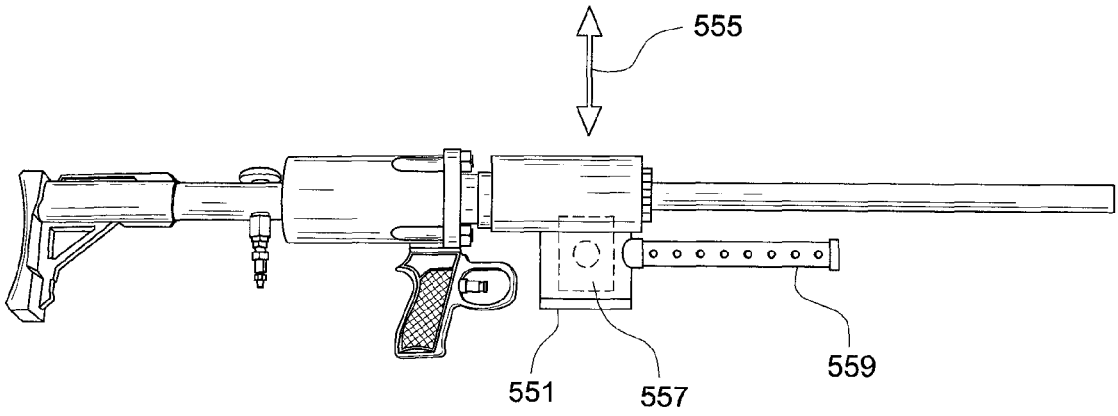
FIG. 5B depicts an embodiment of a spring loaded tube magazine and loading mechanism.

FIG. 5B depicts an embodiment of a spring loaded tube magazine and loading mechanism. The embodiment of FIG. 5B is similar to the loading mechanism depicted in FIG. 4A, except the embodiment of FIG. 5B also has a spring loaded tube magazine configured to feed projectiles into the projectile holding part 557, which is similar to projectile holding part 401 of FIG. 4B, except 557 slides down instead of up. To load the embodiment of FIG. 5B the projectile holding part 557 is slid downward within the loading chamber 551 to expose a projectile holding chamber within projectile holding part 557. This allows the spring loaded tube magazine 559 to load a projectile into the projectile holding chamber of the projectile holding part 557. The projectile holding part 557 is then slid back upward in direction 555 to align the front of the projectile holding chamber (holding the projectile) with the barrel and expose the back of the projectile holding chamber to the gas valve outlet of the air gun's quick-release gas valve. To minimize the gas leakage when the quick-release valve air gun is fired the projectile holding part 557 is configured to fit relatively tightly within the loading chamber 551 as it slides up and down, yet with enough clearance to slide up and down without binding up.

Figure 6A:
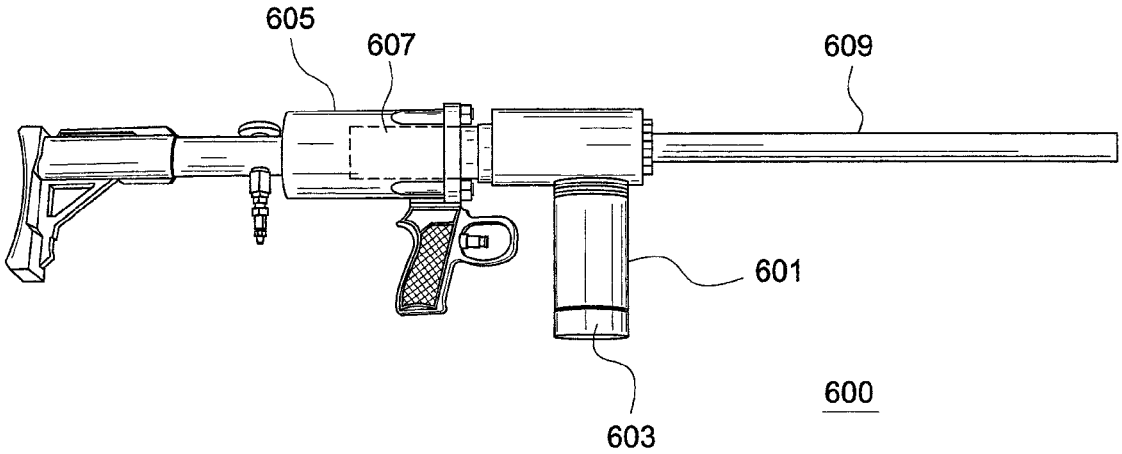
FIG. 6A depicts an embodiment of the quick-release valve air gun having an airtight magazine for loading projectiles.

FIG. 6A depicts an embodiment of the quick-release valve air gun 600 with an airtight magazine 601 for loading projectiles. The projectiles are load into the airtight magazine 601 via a removable magazine cap 603. A spring within the airtight magazine 601 pushes the projectiles up into the firing chamber level with barrel 609. When the quick-release valve air gun 600 is fired the projectile is directed out of the barrel 609 by a pressurized stream of gas released by valve 607 from the primary gas supply tank 605. The airtight magazine 601 is temporarily under pressure as the projectile travels the length of barrel 609, but does not leak any of the pressurized gas since an airtight seal is maintained.

Figure 6B:
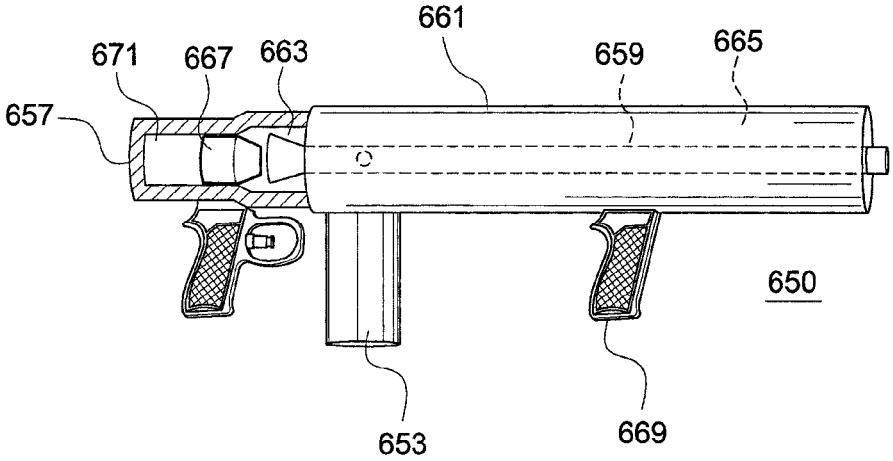
FIG. 6B depicts an embodiment of the quick-release valve air gun with a primary gas supply tank that extends forward around the barrel.

FIG. 6B depicts an embodiment of the quick-release valve air gun 650 with a primary gas supply tank that extends forward around the barrel 659. In FIG. 6B the primary gas supply tank 665 is configured ahead of the quick release valve 657, rather than behind it as depicted in FIG. 6A. The primary gas supply tank is in gaseous communication with a primary gas reservoir of quick release valve 657 at least at a point 663 near the end of a piston 667 which is configured to fit into receptacle 671 of the quick release valve 657. The piston 667 is configured to slide back and forth within the receptacle 671 to controllably open and close the valve 657. Additional details of the operation of the piston and quick release valve are provided below in conjunction with FIGS. 7A-B. The embodiment 650 with the primary gas supply tank 665 positioned ahead of quick release valve 657 tends to shift the weight of the quick-release valve air gun forward. In some embodiments a forward handle 669 is provided, allowing the user to more easily hold and aim the quick-release valve air gun. In some embodiments the primary gas supply tank 665 extends both forward and behind quick release valve 657, tending to provide a more evenly weight-balanced air gun.

FIG. 6B depicts the barrel 659 running through the center of the forward primary gas supply tank 665. In other configurations the barrel 659 is positioned towards the top of the primary gas supply tank 665 rather than running along its center axis. In yet other embodiments, the barrel 659 is outside the primary gas supply tank 665 in a position forward of the quick release valve 657. In such embodiments, some implementations feature the barrel 659 being connected along at least a portion of its length to the primary gas supply tank 665. In other implementations, the barrel 659 and primary gas supply tank 665 are both positioned forward of the quick release valve 657 but are not connected to each other. In yet other embodiments the primary gas supply tank 665 is positioned forward of the quick release valve 657 and a second supply tank such as supply tank 333 of FIG. 3C is positioned behind the quick release valve 657. In other embodiments the supply tank may be positioned forward of the quick release valve 657 with the primary gas supply tank 665 being positioned behind valve 657. In some implementations one or the other of the primary gas supply tank 665 and the supply tank may extend both forward and behind quick release valve 657.

Figure 7A:
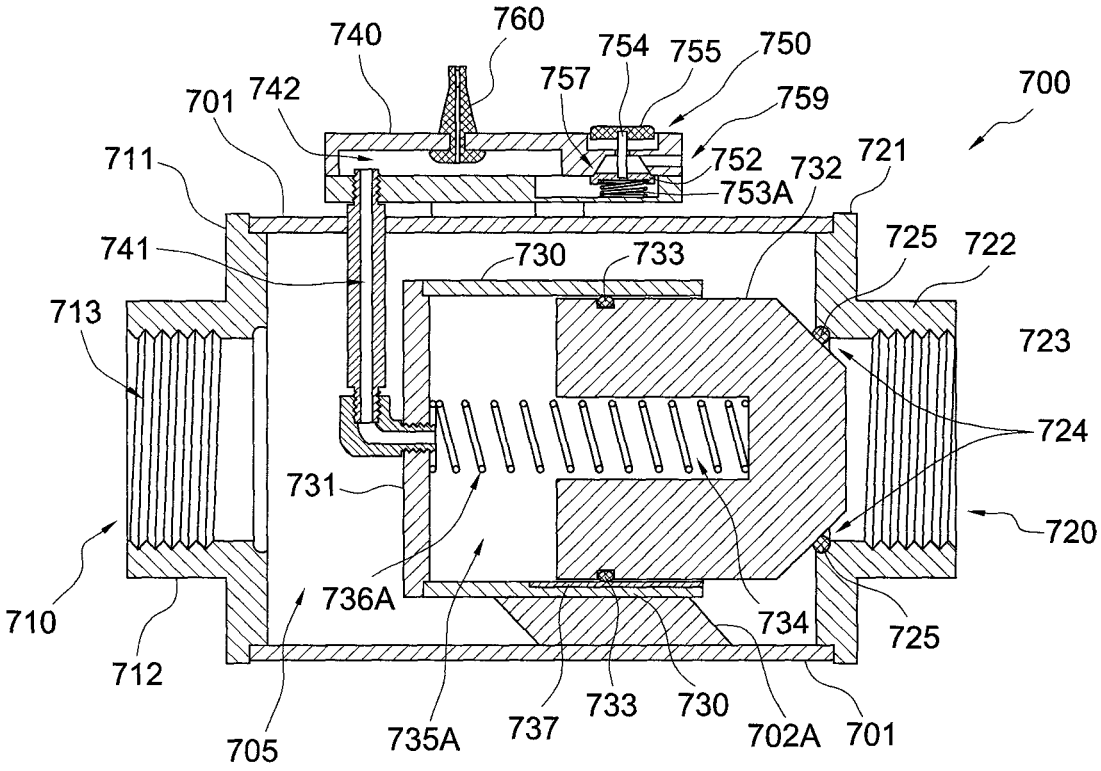
FIGS. 7A-B depict the gas valve portion of various embodiments of the quick-release valve air gun.
Figure 7B:
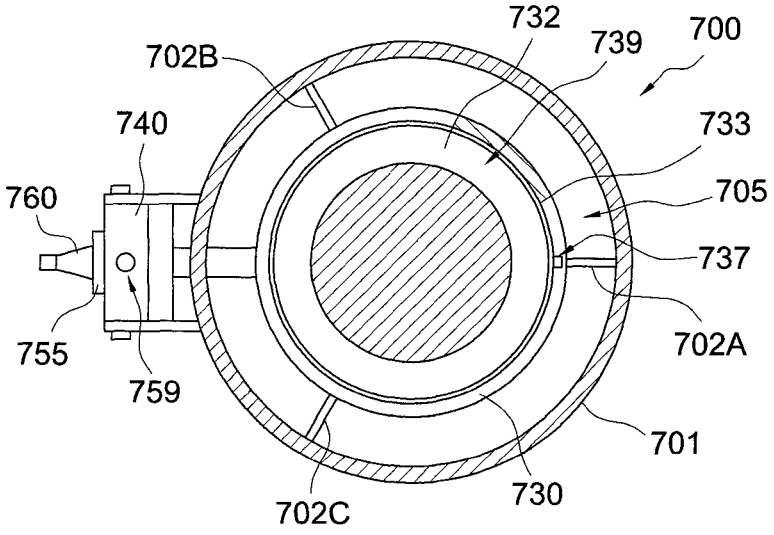

FIGS. 7A-B depict the gas valve portion of various embodiments of the quick-release valve air gun. FIG. 7A is a cross-sectional side view of the quick release gas valve. The gas valve 700 has a cylindrical body 701 with end-caps 711 and 721 attached at either end of the body 701 to form a primary gas reservoir 705. The primary gas reservoir 705 is typically in gaseous communication with a primary gas supply tank, e.g., the supply tank 107 of FIGS. 1A-B. However, in some embodiments the gas valve 700 may be integrally formed with the supply tank so that the supply tank serves as a primary gas reservoir 705. In various embodiments, the primary gas reservoir 705 may be formed with other configurations of parts and may have other shapes such as spherical, cubic, conical, or other volumetric shapes. The term primary gas reservoir body refers to the body 701, end-caps 711 and 721, and/or any other parts or surfaces that form the primary gas reservoir for holding pressurized gas. In the embodiment shown, the end caps 711 and 721 and the body 701 may be made of steel, aluminum, a polymer such as poly-vinyl chloride (PVC) plastic, polycarbonate plastic such as Lexan® from SABIC Innovative Plastics, acrylonitrile butadiene styrene (ABS) plastic, or other like type materials, depending on the targeted operating pressure, size, shape, weight, cost, or other design parameters of a particular embodiment, as would be known to those of ordinary skill in the art. The end caps 711 and 721 may be attached to the body 701 using a method appropriate for the material used, including, but not limited to, welding, gluing, screw-threads, bolts, external clamps, or other methods to create a gas-tight seal.

In the embodiment of FIGS. 7A-B an input end cap 711 is configured with a primary gas input opening 710 which may be formed by an input fitting 712 with threads 713 to accept gas into the primary gas reservoir 705 from an external source that may be connected to the input fitting 712. In various embodiments the input source may be connected to the gas valve 700 using types of connections other than threads, including for example, a quick-connect fitting, a sleeve fitting, or other type of connection that may be held in place with screw threads, glue or other adhesive, a bayonet type mount, a quick-connect, welds, friction, or any other such means that allow a gas-tight, or nearly gas-tight, seal to be formed as the primary gas reservoir is pressurized, as would be known to those of ordinary skill in the art. The output end cap 721 may have a primary gas outlet opening 720 formed by an output fitting 722 with threads 723. The breech end of the air gun barrel, the loading mechanism, or other output conduit may be connected to the output fitting 722 using the threads 723 or other types of connection as described above for the input fitting 712.

The valve is designed so that, upon opening the quick release gas valve, the primary gas input opening 710 is in gaseous communication via a gaseous path with the primary gas outlet opening 720, allowing pressurized gas to flow through the valve and into the barrel of the quick-release valve air gun to shoot a projectile out the barrel. The quick release gas valve can be controllably opened to create a gaseous path from the primary gas reservoir 705 to the barrel of the air gun to fire a projectile from the barrel. After firing, the quick release gas valve is closed to again charge up the pressure in the primary gas reservoir 705. FIG. 7B is a cross-sectional front view taken from the perspective of looking down the barrel of a quick-release valve air gun back towards the quick release gas valve.

FIG. 7A depicts the gas valve 700 in the closed position. In the figure, the piston 732 is seated against the primary gas outlet 724 to block gas from leaving the primary gas reservoir 705 through the primary gas outlet opening 720. In various embodiments the primary gas outlet may be configured as part of the end cap 721 itself, or alternative may be a separate part configured to form a seal with the piston 732 as it extends from receptacle 730 to the closed position. A gasket, O-ring 725, or other type of sealing component may be positioned at the inner edge of the primary gas outlet 724 although other embodiments may position an O-ring on the piston 732 instead. Other embodiments may not require the use of an O-ring 725, depending on the materials used for the piston 732 and the primary gas outlet 724 and manufacturing tolerances of the various parts. The piston 732 may be made of any suitable material including, but not limited to steel, aluminum, PVC, polycarbonate, ABS, and polyacetal polymers such as polyoxymethylene including Delrin® acetal resin from DuPont. In some embodiments the O-ring or other sealing component is mounted on the piston 732 rather than the inner edge of the primary gas outlet 724. The O-ring or other sealing component may be made of rubber, polyacetal, nylon, leather, or other like type of materials suitable for creating an airtight seal as would be known by those of ordinary skill in the art.

The piston 732 is typically shaped to fit into a receptacle 730 (sometimes called a piston receptacle 730) with a closed end 731 and slide in a reciprocating motion in the receptacle 730. The piston 732 is configured to slide back and forth within the cylindrical receptacle 730, with one end of piston 732 (e.g., a chamfered end) extending out of an open end of the receptacle 730. The piston 732 is configured with a chamfered edge on its outer end that slides beyond the edge of receptacle 730 to a closed position (or closed state), mating up with and pressing against the O-ring 725 or other type of seal that is positioned at the inner edge of the primary gas outlet 724. The outer end with the chamfered edge of piston 732 is the end opposite inner end of the piston 732 that holds the compression spring 736A. The spring 736A tends to push the piston 732 in a direction towards a closed state. The inner end of piston 732 and inner walls of the cylindrical receptacle 730 (e.g., the cylindrical inner wall and the inner wall of end-cap 711) form the control reservoir 735A within the receptacle 730. The inner end of piston 732 remains within the cylinder receptacle 730 as the piston 732 slides back and forth between an open state and a closed state (or position). The piston 732 is acted upon by the force of the spring 736A and the control pressure within the control reservoir 735A. The control reservoir 735A has a greater volume when the piston 732 is seated against the O-ring 725 (or other type of seal) and the gas valve 700 is the closed state than when the piston 732 slides back into the piston receptacle 730 and the gas valve 700 is in an open state. The pressure within the control reservoir 735A is lower when the gas valve 700 is the open state than it is when the gas valve 700 is the closed state. Typically, at least a portion of the piston 732 between the open end of receptacle 730 and the O-ring 725 (or other sealing mechanism) is exposed to the primary gas reservoir 705. In the embodiment depicted in FIGS. 7A-B the primary gas reservoir 705 of valve 700 extends back around the receptacle 730. In other embodiments the primary gas reservoir 705 of the valve is smaller, covering only the part (or a portion of the part) of the piston 732 that extends beyond the receptacle 730. Typically, the primary gas reservoir 705 is in gaseous communication with a supply tank that holds a supply of pressurized gas. In the various embodiments at least a portion of the piston 732 that extends beyond the receptacle 730 is in gaseous communication with either the primary gas reservoir 705 or a supply tank.

The receptacle 730 and piston 732 may be cylindrical in shape with a circular cross-section or in other embodiments may have other cross-sectional shapes such octagonal, square, ellipsoid, or other shapes. The receptacle 730 may be positioned by supports 702A, 702B, 702C to allow the piston 732 to slide into position to seal the primary gas outlet 724. The number of supports may vary between embodiments. The supports 702A, 702B, 702C may be fixed to both the outer wall of the receptacle 730 and the inner wall of the body 701 using welding, glue, bolts, or other attachment mechanisms depending on the materials used and the details of the embodiment. In other embodiments, the supports may be fixed to the outer wall of the receptacle 730 and the output end cap 721. A compressed spring 736A may be positioned between the closed end of the receptacle 731 and the piston 732 to provide force to help keep the piston 732 seated against the primary gas outlet 724. In some embodiments, the piston 732 may have a cavity 734 for positioning the compressed spring 736A and providing room for the spring as the piston 732 moves toward the closed end 731. In other embodiments there is a protuberance on the piston 732 that holds the spring 736A in place. The closed end of the receptacle 731 may have either a cavity or a protuberance for holding the spring 736A in place.

The piston 732 may include one or more piston rings 733 that are either fitted around the piston 732 or may be an integral part of the piston 732 and may be interposed between the piston 732 and the receptacle 730 to create a tighter seal than could otherwise be created between the piston 732 and receptacle 730 alone. In various embodiments it is desirable for a controlled amount of pressurized gas from the primary gas reservoir 705 to bleed past the piston 732 and piston ring 733 into control reservoir 735A. This tends to equalize the pressure between the primary gas reservoir 705 and the control reservoir 735A while the gas valve 700 is in the closed state. It should be noted that the primary gas reservoir 705 pressure and the control reservoir 735A pressure do not necessarily need to be equal for the gas valve 700 to remain in the closed state. The primary gas reservoir 705 pressure can be somewhat higher than the control reservoir 735A pressure so long as the force exerted on piston 732 by control reservoir 735A pressure and the spring 736A is sufficient to keep piston 732 closed—that is, to keep the chamfered end of piston 732 mated against the O-ring 725 or other portion of the inner edge of the primary gas outlet 724.

In various embodiments the receptacle 730 has a metering passage 737 configured to allow gas to flow between the primary gas reservoir 705 and the control reservoir 735A. The metering passage 737 may be configured as a groove or other passage in the wall of the receptacle 730 running along the piston 732. The metering passage puts the primary gas reservoir 705 in gaseous communication with the control reservoir 735A. In these embodiments, after the air gun is shot and the primary gas reservoir 705 is being refilled with pressurized gas, the metering passage 737 allows some of the pressurized gas to enter the control reservoir 735A. The force exerted on piston 732 by the spring 736A and by the pressurized gas bleeding via metering passage 737 into the control reservoir 735A acts to push the chamfered end of piston 732 against the O-ring 725 (or other portion of the inner edge of the primary gas outlet 724), thus closing valve 700. A control conduit 741 of valve 700 is configured to release gas from the control reservoir 735A under the control of a trigger valve or other valve or switch mechanism. That is, the pathway of the control conduit 741 may be controllably opened or closed by a trigger valve or other valve or switch mechanism. In the embodiments depicted in FIGS. 7A-B the control conduit 741 provides a switchable pathway the outside atmosphere. In other embodiments the control conduit 741 may provide a switchable pathway to another chamber. Typically, the metering passage 737 has a smaller cross-section than the control conduit 741 and is configured to pass less gas. This way, when the release valve 750 is opened to fire the air gun, a much larger volume of gas rushes out of the control reservoir 735A via the control conduit 741 than the gas rushing through the metering passage 737 into the control reservoir 735A behind the piston 732. This tends to reduce the pressure within control reservoir 735A as compared to the primary gas reservoir 705 pressure, thus opening the valve 700. Typically, the control conduit 741 has a cross-section of from five to ten times as large as the metering passage 737. The ability of the control conduit to carry pressurized gas may be referred to as its gas flow capacity, and is dependent upon its cross-section, volume, length, and to a lesser extent, the other parameters characterizing the control conduit 741. Similarly, the ability of the metering passage to carry pressurized gas may be referred to as its gas flow capacity. Depending upon the configuration and intended usage of the valve 700, the ratio of the control conduit gas flow capacity to the metering passage gas flow capacity may be as small as 2-to-1 (i.e., the control conduit is configured to convey twice as much gas as the metering passage) or as large as 100-to-1, or any range or amount within these amounts. The smaller ratios of control conduit-to-metering passage gas flow capacity (e.g., towards 2-to-1) tend to work better for rapidly refilling the primary gas reservoir 705 than the larger ratios (e.g., towards 100-to-1). The larger ratios tend to make more efficient use of pressurized gas since less gas rushes into the control reservoir 735A behind the piston 732 when the air gun is fired. On the other hand, it may be advantageous in some other embodiments to create a gas-tight seal between the receptacle 730 and the piston 732 while still providing for low friction between the receptacle 730 and the piston 732. In such embodiments the pressure within the control reservoir 735A is controlled either via the control conduit 741, or through the use of another gas line leading into the control reservoir 735A. The piston ring 733 may be made of a material to help minimize the friction and create a good seal such as polyacetal, nylon, leather, rubber, or other material depending on the materials used for the piston 732 and the receptacle 730.

A control reservoir 735A may be created between the closed end 731 of the receptacle 730 and the piston 732. The piston 732 and control reservoir 735A are typically located on the same side of the primary gas outlet opening 720 as the primary gas reservoir 705. As such, the piston 732 may be thought of as holding the valve closed from within the primary gas reservoir 705, rather than from the outside of reservoir 705 (e.g., rather than from outside of primary gas outlet opening 720). The volume of the control reservoir 735A depends on the position of the piston 732 within the receptacle with the largest volume of the control reservoir 735A occurring if the piston 732 is seated against the primary gas outlet 724 as shown in FIG. 7A. A control conduit 741 may pneumatically couples the control reservoir 735A and a plenum 742 in the control block 740, allowing gas to flow between the control reservoir 735A and the plenum chamber 742. In some embodiments the control conduit 741 may pneumatically connect the control reservoir 735A with the outside atmosphere (without a plenum chamber 742), with a valve or trigger switch in the control conduit 741 line to control flow of gas out of the control reservoir 735A which opens and closes the gas valve 700. The gas in the control reservoir 735A may be called control chamber gas to distinguish it from the gas in the primary gas reservoir 705. In some embodiments the primary gas reservoir 705 is used to feed gas into the control reservoir 735A, which in turn is then called control chamber gas. The control conduit 741 may include tubing, pipe, fittings or other hardware. Gas flowing through the control conduit 741 should not be considered as flowing though the primary gas reservoir 705 as the control conduit 741 creates a separation between the gas in the control conduit 741 and the primary gas reservoir 705. The control conduit 741 may exit through the body 701. The exit point may be sealed using a rubber seal, gasket, glue, welding or other method so that gas cannot escape from the primary gas reservoir 705 around the control conduit 741. The control block 740 may be fabricated differently in various embodiments but one embodiment may fabricate the control block 740 using a top section and a bottom section that are then attached using screws, glue, welding or other methods.

A release valve 750 (sometimes called a control valve) is positioned to have an input pneumatically coupled to the control reservoir 735A via the plenum 742 and the control conduit 741. The output of the release valve 750 may be pneumatically coupled to the exhaust port 759. The release valve 750 may be a poppet valve as shown or may be any type of gas valve in other embodiments including, but not limited to, a ball valve, a butterfly valve, a diaphragm valve, or other type of valve that may be manually, electrically, pneumatically, hydraulically, or otherwise controlled. The release valve 750 may include a valve body 752 configured to mate with valve seat 757 to form a gas-tight seal. Spring 753A may provide force to keep the valve body 752 seated against the valve seat 757. A rod 754 (sometimes called a plunger) may connect the valve body 752 to the release button 755.

The fill valve 760, which may also be called a control gas inlet, allows gas from an external source to enter the plenum 740 and flow through the control conduit 741 into the control reservoir 735A without first flowing through the primary gas reservoir. As the control reservoir 735A is pressurized to a control pressure, the gas in the control reservoir 735A provides additional force on the piston 732 to push the piston 732 against the primary gas outlet 724. The control reservoir 735A may be filled with gas and pressurized using various methods in various embodiments, some of which are described below.

The gas reservoir of pressurized gas that is released by the valve is, in practice, typically much larger in volume than control reservoir 735A. This may be achieved by connecting primary gas reservoir 705 to a source of pressurized gas via the primary gas input opening 710. The source of pressurized gas may be a tank or other reservoir, or a pressurized gas line that connects to primary gas reservoir 705 via primary gas input opening 710. Gas may enter the primary gas reservoir 705 using various methods in accordance with the different embodiments of the quick-release valve air gun. For example, in some embodiments the gas enters through the primary gas input opening 710 to pressurize the primary gas reservoir 705 to a primary pressure. If the gas valve is in the closed state, in many applications the pressure at the primary gas output opening 720 will be at standard atmospheric pressure. In some embodiments, however, the pressure at the primary gas output opening 720 may be at pressure level other than standard atmospheric pressure. The calculations below are based on the pressure at the primary gas outlet opening 720 being at the pressure of the surrounding atmosphere if the gas valve 700 is in a closed state. Other pressure levels are measured with respect to the pressure of the surrounding atmosphere.

The closing forces operating on the piston 732 include the force of the compressed spring 736A and/or the force of the gas in the control reservoir 735A operating on the piston 732 which is equal to the control pressure times the cross-sectional area of piston 732 at its largest point which will be referred to hereinafter as the piston area. In many embodiments, the piston area may be equal to the cross-sectional area of the piston at the piston ring 733. The opening forces on piston include the force of any pressure at the primary gas outlet opening 720 times the cross-sectional area of the of the primary gas outlet opening 720, hereinafter referred to as the outlet area, and the force of the gas in the primary gas reservoir 705 operating on the piston 732 which is equal to the primary pressure times the difference in the piston area and the outlet area. The area represented by the difference in the piston area and the outlet area can be seen as the annular ring 739 in FIG. 7B.

The gas valve 700 may be opened by opening the release valve 750 by pushing on the release button 755 which uses the rod 754 to move the valve body 752 away from the valve seat 757 which also compresses the spring 753A. Opening the release valve 750 allows the pressurized gas in the control reservoir 735A to pass through the control conduit 741, the plenum 742, the open release valve 750, and the exhaust port 759. This tends to cause the control pressure to drop toward the surrounding atmospheric pressure. As the control pressure drops, the closing force on the piston 732 is reduced. If the control pressure drops to a release pressure, the opening force on the piston 732 exceeds the closing force, causing the piston 732 to slide and begin to open within the receptacle 730. This allows gas to escape through the primary gas outlet 724 which tends to increase the pressure at the primary gas outlet 724. This increases the opening force on the piston 732 and even though the control reservoir 735A is being made smaller and the compressed spring 736A is being further compressed, both of which tend to increase the closing force on the piston 732. However, the increased opening force overcomes the closing force and the piston 732 slides rapidly into the receptacle, quickly opening the gas valve 700. In the inventor's estimation, many embodiments may switch between a closed state and an open state in less than 0.10 seconds (s). Some embodiments may open in a few tens of milliseconds (ms) such as 20-50 ms, while other embodiments may open even faster and some may open more slowly than 0.10 second.

The terminology used herein is for the purpose of describing particular embodiments only, and is not intended to be limiting of the invention. As used herein, the singular forms "a", "an" and "the" are intended to include the plural forms as well, unless the context clearly indicates otherwise. It will be further understood that the terms "comprises," "comprising," "includes," and/or "including" used in this specification specify the presence of stated features, integers, steps, operations, elements, and/or components, but do not preclude the presence or addition of one or more other features, integers, steps, operations, elements, components, and/or groups thereof. The term "plurality", as used herein and in the claims, means two or more of a named element. A "plurality" should not be interpreted to necessarily refer to every instance of a given element in the entire device. For example, "each" of a plurality of a given element refers to the members of the "plurality" of the given elements, but there may be others of the given element aside from the plurality. That is, there may be additional elements in the entire device that are not be included in the "plurality" and are not, therefore, referred to by "each." The term "gaseous communication" means that gas can flow between, and in some instances, through to parts. For example, in various embodiments the primary gas reservoir is in gaseous communication with the air gun barrel, with the quick-release gas valve being configured in the gaseous path to control the flow of gas to the barrel. The "backward" and "forward" directions (or "back" and "forth" directions) relative to the quick-release air gun refer to the direction the projectile shoots from the barrel (forward) and the opposite direction (backward). Typically, the muzzle end of the barrel is the forward end and the breech end is the backward end of the barrel. The terms "airtight" and "gas-tight" are used interchangeably herein. Both the term "airtight" and the term "gas-tight" mean that not more than a substantially small amount of gas (air or other gas) leaks past the airtight or gas-tight. For example, in various embodiments a "airtight" or "gas-tight" seal will maintain either 98% or more of the pressure being held within a chamber, or alternatively will lose 2% or less of the gas being held by the "airtight" or "gas-tight" seal, over the course of a minute at normal operational pressures. It should be noted that the terms "gas" and "gaseous" refer to materials in their gaseous state, not their liquid state (e.g., nitrogen, carbon dioxide, oxygen, etc.). The high speed gas valve embodiments disclosed herein operate in a different manner than valves designed for liquids. Liquids tend to have much higher viscosities than gases, and thus would not likely be able to traverse the control conduit and the metering passage without drastically redesigning the valve. Moreover, the relatively higher viscosity of liquids would not allow the quick-release valve to open and close properly in response to the interaction between the pressure in the primary gas reservoir, the pressure in the control reservoir, the control conduit, the metering passage and the compression spring of the various quick-release valve embodiments disclosed herein. Finally, opening various embodiments of the high speed gas valve disclosed herein result in the contents of the control reservoir being sprayed into the atmosphere—a result that, if it was even possible, would be unacceptable in nearly any situation calling for a valve.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description in order to clearly disclose the various embodiments of the quick-release valve air gun. The description is not intended to be, nor would it be possible to be, completely exhaustive as to all superficial details and minor characteristics of the various embodiments of the quick-release valve air gun. Many modifications and variations will be apparent to those of ordinary skill in the art without departing from the scope and gist of the invention. For example, the various steps of the method claims may, in some instances, be performed in an order other than the order of the steps recited in the claims. In some implementations it may happen that some steps may be performed simultaneously with one or more of the remaining steps of the recited method. In some instances additional steps may be performed in addition to those recited in the claims. In regards to the accompanying drawings, it is not thought that the various steps of the method claims lend themselves to illustration inasmuch as it is believed that the addition of block diagrams would not aid in further illuminating the various method steps recited in the claims to any greater degree than the various text descriptions provided in this disclosure. The various text descriptions, examples, and embodiments included herein were chosen and described in order to clearly explain the principles of the invention and the practical application, and to enable those of ordinary skill in the art to understand the embodiments of the invention with various modifications as are suited to the particular use contemplated.

What is claimed is:

1. A quick-release valve air gun for shooting a projectile, comprising:

a barrel with a muzzle end and a breech end;

a primary gas reservoir of a gas valve configured with a primary gas outlet in gaseous communication with the breech end of the barrel;

a piston receptacle mounted within the primary gas reservoir so as to be surrounded by the primary gas reservoir;

a piston with an inner end configured to slide into the piston receptacle and with an outer end that provides the gas valve with an airtight seal in a closed state, wherein a control reservoir having a control pressure is formed within the piston receptacle between an inner end of the piston and inner walls of the piston receptacle;

a compressed spring positioned between a closed end of the piston receptacle and the piston to produce a compression spring force on the piston, a sum of control pressure force from the control pressure and the compression spring force acting to push the piston towards the primary gas outlet, wherein an opening force acts to push the piston in a direction opposite the compression spring force and the control pressure force, the opening force being equal to an outlet pressure acting on the outlet area of the primary gas outlet plus a primary gas pressure within the primary gas reservoir acting on an area equal to the cross-sectional area of the piston less the outlet area;

a control conduit in gaseous communication with a trigger means to provide a controllable pathway for releasing control chamber gas from the control reservoir to outside the quick-release valve air gun; and the trigger means for releasing the control chamber gas from the control reservoir causing the piston to slide away from the primary gas outlet to an open state;

wherein the piston sliding away from the primary gas outlet to the open state releases a sufficient amount of high pressure gas from the primary gas reservoir into the breech end of the barrel to drive the projectile down the barrel out the muzzle end.

2. The quick-release valve air gun of claim 1, further comprising:

a metering passage configured to provide gaseous communication between the primary gas reservoir to the control reservoir;

wherein a first gas flow capacity of the control conduit is at least three times as large as a second gas flow capacity of the metering passage; and wherein the piston receptacle has a cylindrical inner surface and is positioned within the primary gas reservoir.

3. The quick-release valve air gun of claim 1, wherein the projectile weighs at least three pounds.

4. The quick-release valve air gun of claim 1, wherein the primary gas outlet has an inner edge within the primary gas reservoir, the quick-release valve air gun further comprising:

a sealing component mounted on the inner edge of the primary gas outlet;

wherein the piston has a chamfered edge on the outer end configured to mate up with the sealing component in the closed state of the gas valve.

5. The quick-release valve air gun of claim 4, wherein the sealing component is an O-ring.

6. The quick-release valve air gun of claim 1, wherein the control reservoir has a greater volume in the closed state of the gas valve than in the open state of the gas valve.

7. The quick-release valve air gun of claim 6, wherein a control reservoir pressure within the control reservoir is lower in the open state of the gas valve than in the closed state of the gas valve.

8. The quick-release valve air gun of claim 1, wherein, in response to manipulating the trigger means the control chamber gas in the control reservoir escapes to the outside of the quick-release valve air gun causing the piston to quickly slide away from the primary gas outlet to the open state within 100 milliseconds.

9. The quick-release valve air gun of claim 8, wherein the trigger means is a trigger valve with a plunger for operating the trigger valve.

10. The quick-release valve air gun of claim 1, wherein the barrel is one of a plurality of barrels each in gaseous communication with the primary gas outlet.

11. The quick-release valve air gun of claim 10, wherein the projectile is one of a plurality of projectiles interconnected by a net, each of the plurality of projectiles being configured to fit into one of the plurality of barrels.

12. The quick-release valve air gun of claim 10, wherein the primary gas reservoir is in gaseous communication with a supply tank, at least part of the supply tank being positioned between the muzzle end of the barrel and the trigger means.

13. A method of configuring a quick-release valve air gun to shoot a projectile, the method comprising:

providing a barrel with a muzzle end and a breech end;

providing a primary gas reservoir of a gas valve, the primary gas reservoir being having primary gas outlet that opens into the breech end of the barrel;

mounting a piston receptacle of the gas valve to be in gaseous communication with the primary gas reservoir and to be surrounded by the primary qas reservoir;

configuring a piston with an inner end configured to slide into the piston receptacle and with an outer end that provides the gas valve with an airtight seal in a closed state closing gaseous communication between the primary gas reservoir and the breech end of the barrel, wherein a control reservoir having a control pressure is formed within the piston receptacle between an inner end of the piston and inner walls of the piston receptacle;

providing a compressed spring between a closed end of the piston receptacle and the piston to produce a compression spring force on the piston, a sum of control pressure force from the control pressure and the compression spring force acting to push the piston towards the primary gas outlet, wherein an opening force acts to push the piston in a direction opposite the compression spring force and the control pressure force, the opening force being equal to an outlet pressure acting on the outlet area of the primary gas outlet plus a primary gas pressure within the primary gas reservoir acting on an area equal to the cross-sectional area of the piston less the outlet area;

providing a control conduit in gaseous communication with a trigger means to create a controllable pathway for releasing control chamber gas from the control reservoir to outside the quick-release valve air gun; and providing the trigger means for releasing the control chamber gas from the control reservoir causing the piston to slide away from the primary gas outlet to an open state;

wherein the piston sliding away from the primary gas outlet to the open state releases a sufficient amount of high pressure gas from the primary gas reservoir into the breech end of the barrel to drive the projectile down the barrel out the muzzle end.

14. The method of claim 13, further comprising:

providing a metering passage configured to put the primary gas reservoir in gaseous communication with the control reservoir;

wherein a first gas flow capacity of the control conduit is at least three times as large as a second gas flow capacity of the metering passage;

wherein the piston receptacle has a cylindrical inner surface and is positioned within the primary gas reservoir; and wherein the projectile weighs at least three pounds.

15. The method of claim 13, wherein the primary gas outlet has an inner edge within the primary gas reservoir, the method further comprising:

providing a sealing component mounted on the inner edge of the primary gas outlet;

wherein the piston has a chamfered edge on the outer end configured to mate up with the sealing component in the closed state of the gas valve.

16. The method of claim 15, wherein the sealing component is an o-ring.

17. The method of claim 13, wherein the control reservoir has a greater volume in the closed state of the gas valve than in the open state of the gas valve; and wherein a control reservoir pressure within the control reservoir is lower in the open state of the gas valve than in the closed state of the gas valve.

18. The method of claim 1, wherein, in response to manipulating the trigger means the control chamber gas in the control reservoir escapes to the outside of the quick-release valve air gun causing the piston to quickly slide away from the primary gas outlet to the open state within 100 milliseconds.

* * * * *